US008931657B2

(12) United States Patent
Kientzle et al.

(10) Patent No.: US 8,931,657 B2
(45) Date of Patent: Jan. 13, 2015

(54) PHARMACEUTICAL CONTAINER WITH CHILD-RESISTANT CLOSURE

(71) Applicant: Pioneer Plastics, Inc., Eagan, MN (US)

(72) Inventors: Volker Kientzle, Eden Prairie, MN (US); Nathan T. King, Rosemount, MN (US)

(73) Assignee: Pioneer Plastics, Inc., Eagan, MN (US)

( * ) Notice: Subject to any disclaimer, the term of this patent is extended or adjusted under 35 U.S.C. 154(b) by 0 days.

(21) Appl. No.: 13/681,104

(22) Filed: Nov. 19, 2012

(65) Prior Publication Data

US 2013/0320017 A1 Dec. 5, 2013

Related U.S. Application Data

(60) Provisional application No. 61/561,511, filed on Nov. 18, 2011.

(51) Int. Cl.

| | |
|---|---|
| ***B65D 43/20*** | (2006.01) |
| ***A61J 1/03*** | (2006.01) |
| ***B65D 50/00*** | (2006.01) |
| ***B65D 21/02*** | (2006.01) |
| ***B65D 65/46*** | (2006.01) |
| ***B65D 47/28*** | (2006.01) |
| ***B65D 50/04*** | (2006.01) |

(52) U.S. Cl.

CPC . *A61J 1/03* (2013.01); *B65D 43/20* (2013.01); *B65D 50/00* (2013.01); *B65D 21/0233* (2013.01); *B65D 65/466* (2013.01); *B65D 47/286* (2013.01); *B65D 50/046* (2013.01)

USPC ..... 220/345.3; 220/254.9; 206/514; 206/519; 215/211

(58) Field of Classification Search

CPC ..... B65D 50/046

USPC ..... 220/345.3, 345.2, 345.1, 254.9, 254.7, 220/254.1, 781, 267, 247, 519; 215/211, 215/213

See application file for complete search history.

(56) References Cited

U.S. PATENT DOCUMENTS

| | | | | |
|---|---|---|---|---|
| 873,217 | A * | 12/1907 | Derge | 206/247 |
| 3,240,373 | A * | 3/1966 | Dulle | 215/215 |
| 4,819,829 | A * | 4/1989 | Rosten et al. | 220/345.3 |
| 6,976,577 | B2 * | 12/2005 | Devine | 206/37 |
| 7,114,619 | B2 * | 10/2006 | Ellis et al. | 206/540 |
| 7,543,705 | B2 * | 6/2009 | Yourist | 206/519 |
| 2008/0035643 | A1 * | 2/2008 | Hoffman et al. | 220/345.4 |
| 2011/0108508 | A1 * | 5/2011 | Kientzle | 215/228 |
| 2012/0067889 | A1 * | 3/2012 | Lai | 220/254.1 |

* cited by examiner

*Primary Examiner* — Anthony Stashick
*Assistant Examiner* — Mollie Llewellyn
(74) *Attorney, Agent, or Firm* — Briggs and Morgan, P.A.

(57) ABSTRACT

A pharmaceutical container including a bottle having a bottom wall and side walls. A ridge proximate to the bottom wall projects from an interior surface of at least one of the side walls, to facilitate nested stacking of a plurality of bottles. One or more of the side walls includes a cover locking receptacle proximate to the top end of the side wall. The pharmaceutical container also includes a cover including a sliding lid contained in a cover housing. The cover housing has a top wall, which includes an opening, and cover side walls. A child-resistant closure mechanism is also provided to limit the movement between the sliding lid and the bottle.

23 Claims, 30 Drawing Sheets

PHARMACEUTICAL CONTAINER WITH CHILD-RESISTANT CLOSURE

RELATED APPLICATIONS

This application claims the benefit of U.S. Provisional Application No. 61/561,511, filed Nov. 18, 2011, which is incorporated herein by reference.

TECHNICAL FIELD

The present invention relates generally to containers for pharmaceuticals, and is particularly concerned with a sliding lid, non-round container of the type including a bottle with a cover mounted thereon and incorporating child-resistant features, wherein the cover includes a lid for slidable movement between open and closed positions with respect to the bottle.

BACKGROUND OF THE INVENTION

There is an increasing awareness of the requirement to protect children from inadvertently gaining access to pharmaceutical medications. However, this requirement is often balanced with the necessity to provide containers for medications that may otherwise may be readily and easily opened by an adult, i.e., any person having the cognitive ability to understand the instructions for opening a container requiring a certain manipulation and manual dexterity. Such persons are assumed, as well, to have the ability to understand that opening a container to gain access to the medication therein is a deliberate action, and is only undertaken when there is a necessity to attain access to the pharmaceutical medication contained therein.

In order to reduce the number of accidental poisonings resulting from young children having access to unsafe medicines, drugs and other potentially dangerous substances, considerable effort has been made toward developing child-proof safety packaging. To fulfill the criteria of a child-proof safety package, a container and cap or cover must be constructed in such a manner that the type of manipulation required to open the container to gain access to its contents is one that a young child is not capable of performing.

Often, such adults have the sufficient manual dexterity to open a container, but may suffer from a debilitating condition such as arthritis. Such persons may still desire to have their medications in containers that require specific manipulation and manual dexterity, and thus child-resistance, but with lesser physical effort.

There are several well-known child-resistant containers in the market that are capable of dispensing one or a plurality of dosage forms such as tablets, gel-caps, capsules, or the like. They include the so-called "arrow-alignment" closures or the "push-and-turn" closures. In both cases, the containers are of the standard cylindrical variety.

The push-and-turn systems require that the closure be pushed axially downwardly and rotated at the same time. Disadvantageously, very considerable force, which is often beyond that which can easily be exerted by arthritic patients, may be required. Moreover, the specific force required between two otherwise identical, push-and-turn closures and containers, often differs from one to the other.

A user of closures having the arrow-alignment systems often needs to have relatively good eyesight in order to properly align an arrow on the closure or cap with an arrow typically embossed on the container. Even after the arrows are aligned, a user may still need to exert a very considerable force to push up the cap away from the container, so as to remove the cap, which also may be difficult for an arthritic patient.

Currently produced pharmaceutical containers tend to be cylindrical in shape and not very space efficient. These containers may not be easily stacked except in an end-to-end fashion. Moreover, placement of a number of cylindrical pharmaceutical containers together on a shelf results in an inefficient use of the volume in which they are placed due to the spaces left between the curved cylindrical walls.

Another disadvantage associated with closures suitable for cylindrical tablet containers is that the closure becomes physically separated from the container upon opening. The closure may then either become lost, or in the event where multiple medications are being dispensed, may inadvertently be secured incorrectly or loosely secured onto the wrong container. Still further, there is also a risk that children may place the separated cap into their mouth, which might result in choking.

It would be desirable to have a child-resistant closure that is suitable for use in non-cylindrical shaped containers, that is not easily removed from its container, and that may be opened by adults who may have compromised hand strength.

There is a strong need for a system that allows nested bottles to be loaded onto a conveyor system for filling. The system of the present invention provides this and other advantages.

All too frequently, errors are made by pharmacists or their assistants in filling prescriptions. Some of these errors are caught by the patient who notices the difference in the medication compared to medication previously obtained for the same prescription. However, under certain circumstances, the patient may not notice the error. For example, the erroneous medication, e.g., a pill, and the correct pill may be similar in appearance, or the error may occur the first time that the prescription is being filled. In other instances, the patient may simply fail to notice the mistake because differences in the size and/or color of the pills are difficult to detect, particularly if the patient has less than perfect vision.

Errors in the filling of prescriptions can arise from a variety of circumstances. In many instances, the error can be attributed to the inattention of the pharmacist, particularly during times when there is a need to fill a large number of prescriptions. Also, the error can be occasioned by the lack of experience of the pharmacist with the particular prescription, or the general lack of experience of the pharmacist's assistant. Other errors can be caused by the similarity of unrelated pills in color and/or shape. Errors can also arise from name similarities, e.g., Feldene/Seldane, Lodine/Codeine, etc.

SUMMARY OF THE INVENTION

In accordance with the present invention, there is provided a child-resistant closure for containers. The bottle or cover may be molded with opaque or transparent tint or colors to customize the container for individual identification. Thus, a family or shared housing member can easily distinguish their selected bottle or cover color as being noticeably different than others. This can aid in ensuring the prescription is taken by the appropriate person.

An object of this invention is to provide a sliding lid pharmaceutical container of the type wherein a container has a cover mounted thereon, wherein the cover includes a lid for slidable movement between open and closed positions with respect to the container.

A more specific object is to provide a sliding lid pharmaceutical container wherein a sliding is mounted in a cover housing for slidable movement between open and closed positions, and wherein resilient locking means is provided on the cover housing and sliding lid. The resilient locking means may comprise resilient locking members engaging detent structures of the sliding lid.

Yet another object of the present invention is the provision of multiple stackable bottles, yielding space savings which are particularly useful within automated dispensing equipment.

In carrying out the foregoing, and other objects, an embodiment of a pharmaceutical container according to the present invention includes a bottle and cover, the bottle having a bottom wall and side walls. Each side wall has a top end and a bottom end, and the bottom end of each side wall is connected to the bottom wall. One or more of the side walls includes a cover locking receptacle proximate to the top end of the side wall. A ridge proximate to the bottom wall projects from an interior surface of at least one of the side walls. The cover has a sliding lid contained in a cover housing. The cover housing has a top wall, which includes an opening, and four cover side walls. A bottle locking lug projects from the exterior surface of at least one of the cover side walls. This bottle locking lug is adapted to engage the cover locking receptacle of the bottle.

Lid retainers and lid locking lugs project from interior surfaces of cover side walls of the cover housing. The lid retainers engage the sliding lid such that the sliding lid is slidably mounted in the cover housing. The sliding lid is adapted to slide between an open position and a closed position.

The sliding lid includes four side edges. The side edges include grooves adapted to engage the lid locking lugs of the cover housing. The grooves of the sliding lid and the lid locking lugs of the cover housing may constitute locking means, providing resistance when moving the sliding lid from an open position to a closed position, and from a closed position to an open position.

In some embodiments, resilient biasing means are engaged between the sliding lid and the cover housing so that the sliding lid can slide from its closed position upon axial movement of the sliding lid with respect to the cover housing against the biasing means. In one embodiment, the resilient biasing means includes a lug and detent structure defined on portions of the cover housing and sliding lid.

The present invention is also directed to an array of pharmaceutical containers, including a plurality of bottles which are stacked, or nested. When a first bottle is nested inside a second bottle in accordance with the present invention, the bottom wall of the first bottle contacts a top edge of a ridge projecting from an interior surface of at least one of the side walls of the second bottle. This ridge is proximate to the bottom wall. In this way, a first bottle is prevented from being nested so tightly into a second bottle that it becomes difficult to remove from the second bottle.

The present invention is also directed to improved bottles for prescription drugs, and in particular to improved prescription drug bottles incorporating means to aid the pharmacist and the patient in noting when an error has been made in the filling of the prescription.

The present invention is particularly directed to prescription containers of the kind used to hold prescription medicines sold in solid form, e.g., pills, tablets, caplets, suppositories, or capsules. These medications in solid form will be referred to herein, for convenience and brevity, as "pills." Generally, these containers are comprised of a bottle into which the pills are placed through an opening, a cap or cover attachable over the opening and a label that is affixed to the bottle. It will be understood, however, that the concepts forming the basis of the present invention can also be applied to medications in non-solid forms, such as liquids, ointments, or gels, etc., and to other receptacle configurations.

In one embodiment of the present invention, the bottle is generally of a tapered rectangular shape, having a continuous side wall with continuous upper and lower edges, and a bottom wall or base extending across the lower edge of the side wall. The bottom wall is sized to be received within an opening of an adjacent bottle, allowing a plurality of bottles to be presented in nested stack form. The bottle is structured adjacent the top end, or upper edge, of the side wall to receive a correspondingly structured cover used to close the bottle opening formed by the top ends of the side walls. The side wall may be structured on its outer surface, its inner surface, or both, depending upon the particular cover design. Additionally, the side wall may include locking receptacles or locking projections on its interior surface adjacent the top end, forming part of a locking mechanism. Usually, the side walls and bottom are integrally molded from a plastic.

The cover is normally molded from plastic material and is designed to be secured over the bottle opening. The cover may be pressed onto the top of the bottle. The exterior of the cover may include locking lug(s) to join with locking receptacle(s) on the corresponding bottle.

When a prescription is to be filled, the pharmacist, or his or her assistant, selects a large container of pills corresponding to the medication to be prescribed, transfers the designated number of pills from the large container to a bottle, and caps the bottle with its matching cover. An instruction sheet may also be included on or in the bottle. The pharmacist or assistant then types information about the prescription onto a label, and attaches the label to the side wall of the bottle.

Labels are normally pre-printed with standard information common to all prescriptions filled at the particular pharmacy, including the name, address and telephone number of the pharmacy. Information unique to the prescription, such as the patient's name, doctor's name, the name of the prescribed medicine, instructions for use, number of refills, etc., are then typed onto the label at the time the prescription is filled.

The present invention is directed to modifications of conventional pharmaceutical containers and the related procedures for their preparation that may be used alone or in combination to significantly increase the likelihood that the pharmacist or the patient will detect an error in filling the prescription in question.

A bottle in accordance with the present invention offers easy carton stacking, unlike traditional vials and caps which are shipped to pharmacies separated in large bulk bags. Therefore, the bottle design may allow drug stores to realize considerable shipping, storage and handling savings. The separate covers may be shipped in a separate portion of a master carton, which may be designed to offer a dispenser style magazine retention option for easy pharmacist storage and access.

The invention is also designed to be molded with a biodegradation agent to ensure that the container will degrade and eventually biodegrade if discarded as refuse and placed into a landfill environment.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Figure 1:
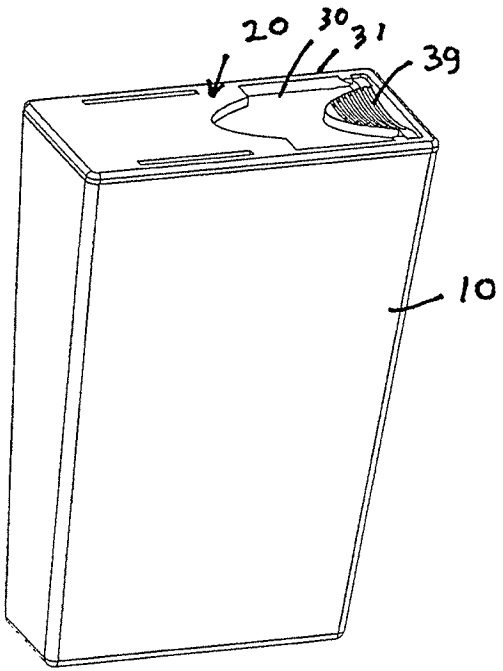
FIG. 1 is a perspective view of an embodiment of a pharmaceutical container in accordance with the present invention, including a bottle and cover.

FIG. 1 depicts an embodiment of a pharmaceutical container of the present invention. The pharmaceutical container shown in FIG. 1 includes a tapered rectangular bottle 10 and a cover 20. The cover 20 includes a sliding cover 30 which is slidably mounted in the cover housing 31 for movement between open and closed positions with respect to the bottle 10. A finger lug 39 is provided to assist in opening and closing the sliding cover 30.

Figure 2:
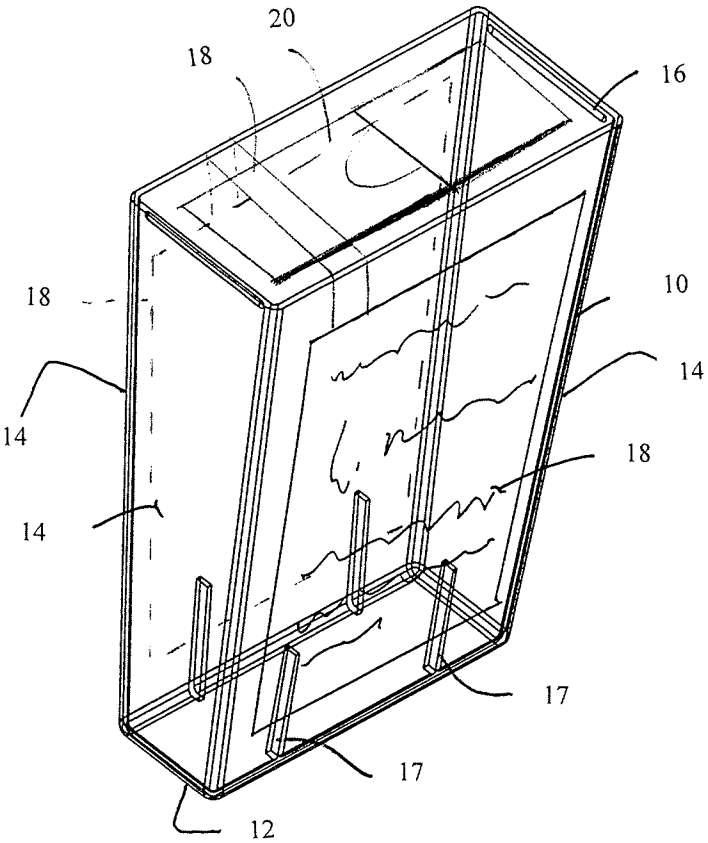
FIG. 2 is a perspective view of a pharmaceutical container in accordance with the present invention, including the bottle of FIG. 1, a cover, and a label.

FIG. 2 is an illustration of the tapered rectangular bottle 10 including a bottom wall 12 and side walls 14. Two of the side walls 14 include a cover locking receptacle 16 proximate to the open end of bottle 10. As described hereinafter, the cover locking receptacle 16 engages a locking lug of cover 20. A label 18 is provided on side wall 14. Multiple labels 18 may be provided on a single bottle 10. The label 18 may extend across cover 20 to assist in securing cover 20 to bottle 10. In the embodiment shown in FIG. 2, the label 18 includes two end portions and an intermediate bridge portion. The end portions, which are sized in relation to the side walls of the bottle, are affixed to side walls 14. The end portions are connected together via the intermediate bridge portion of the label, which extends across, and is affixed to, the cover 20.

Figure 19:
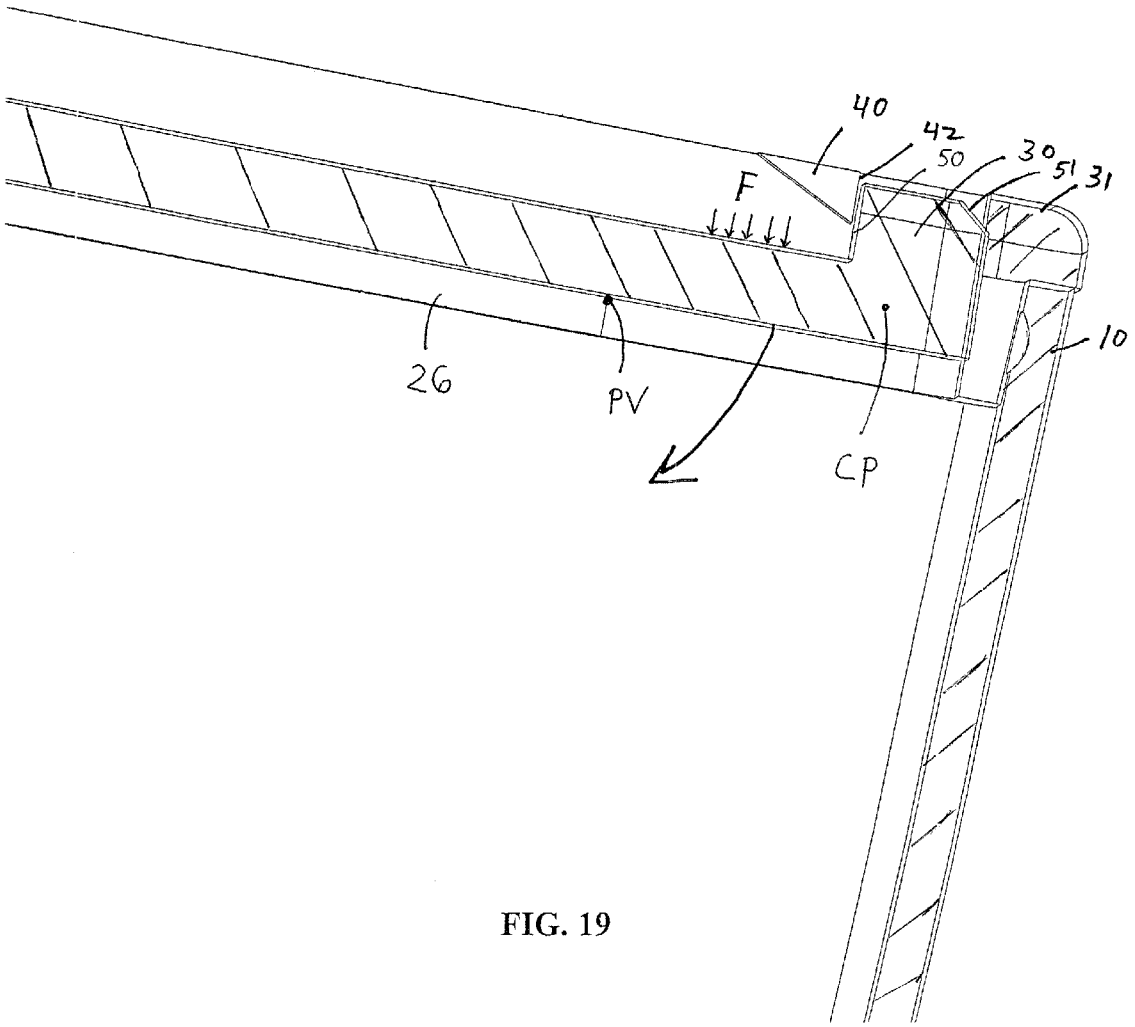
FIG. 19 is a cross-sectional view of a portion of the cover of FIG. 15.
Figure 28:
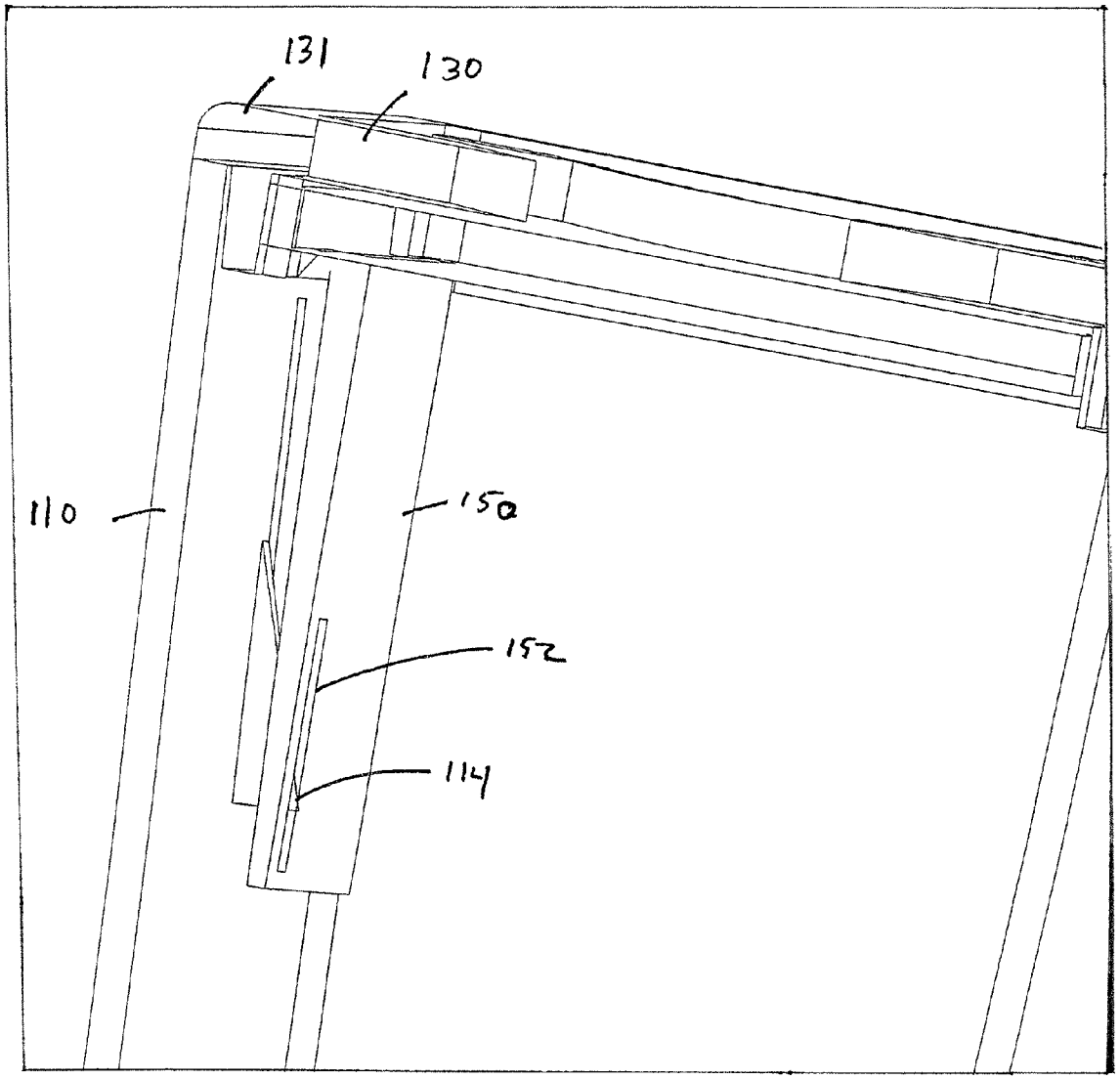
FIG. 28 is a cross-sectional view of a portion of the pharmaceutical container of FIG. 20.

The bottle 10 of FIG. 2 also includes ridges 17, projecting from the interior surface of side walls 14. The ridges 17 are proximate to the bottom wall 12. The embodiment shown in FIG. 2 includes four ridges 17, with two ridges 17 projecting from one side wall 14, and two ridges 17 projecting from the opposite side wall 14. These ridges 17 facilitate the separation of nested bottles 10, as discussed below. In other embodiments, any number of the side walls, from one side wall to four side walls, may include one or more ridges 17. It is intended that the bottle 10 will be offered in multiple sizes to accommodate the varying sizes of pills but in any size can be alternatively molded to accommodate either locking design as shown in FIGS. 19 and 28.

Figure 3:
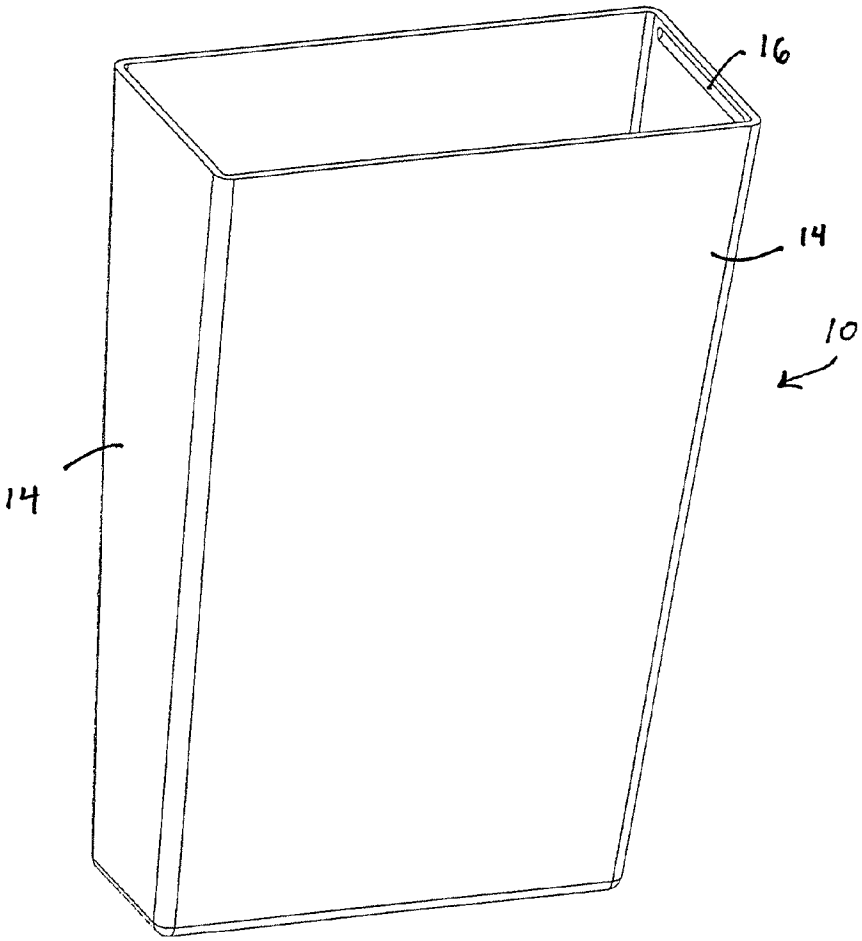
FIG. 3 is a perspective view of the bottle of FIG. 1.

FIG. 3 is a detailed portion of the bottle 10 showing the cover locking receptacle 16. In the embodiment shown in FIG. 3, each side wall 14 includes a cover locking receptacle 16. However, in some embodiments, not all of the side walls 14 include a cover locking receptacle 16. For example, in the embodiment shown in FIG. 2, only two of the side walls 14 include a cover locking receptacle 16.

Figures 4A, 4B, 4C, 4D:
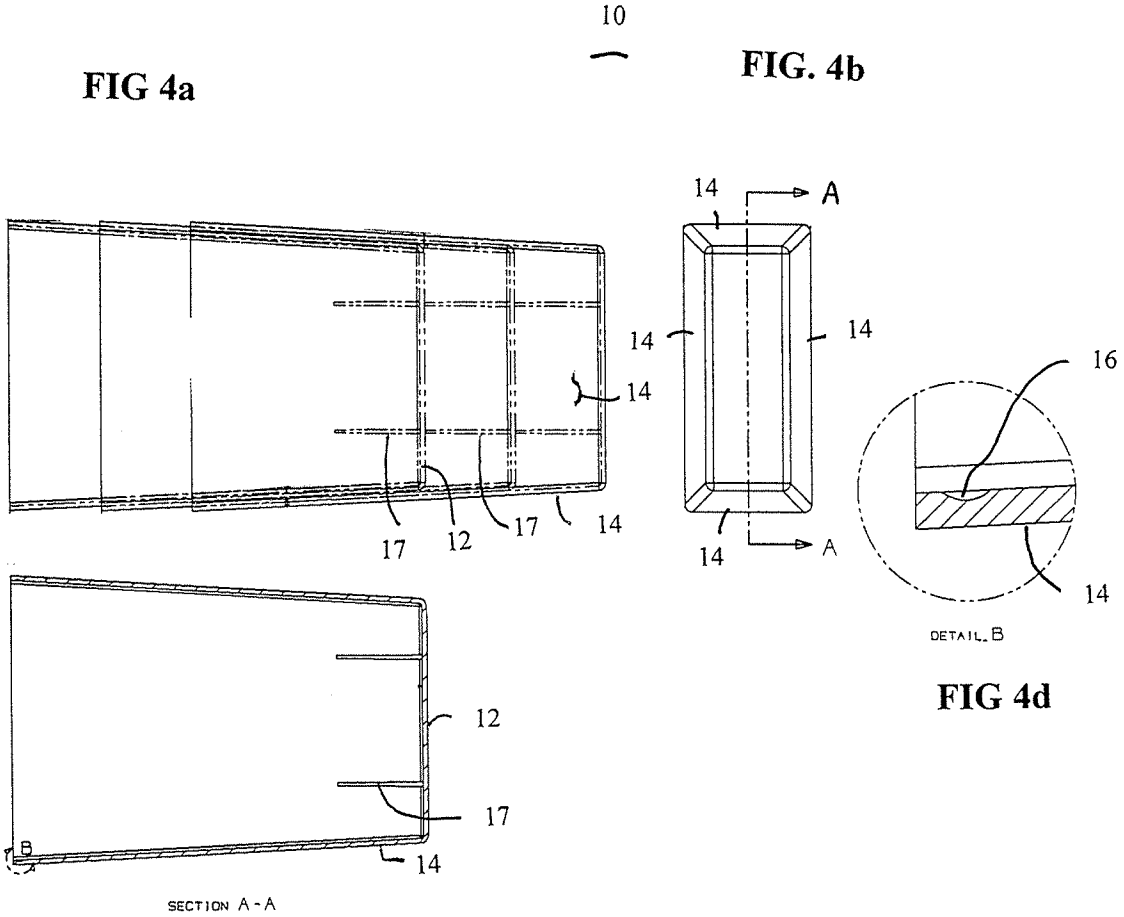
FIG. 4*a* is a side view of bottles in accordance with the present invention in a nested stack.
FIG. 4*b* is a bottom view of a bottle in accordance with the present invention.
FIG. 4*c* is a cross-sectional view of the bottle of FIG. 4*b* taken through section A-A.
FIG. 4*d* is a detailed view of region B of FIG. 4*c;*

FIG. 4 provides various views of bottle 10. FIG. 4*b* is a bottom view of bottle 10. FIG. 4*a* shows a side view of a plurality of bottles 10, wherein the bottles are stacked in a nested configuration. When the bottles 10 are nested, such that a first bottle is received within a second bottle, the bottom wall 12 of the first bottle contacts a top edge of the ridges 17 of the second bottle. The ridges therefore provide a limit on how far a first bottle may be nested into a second bottle, thereby preventing the nested bottles from becoming stuck together.

FIG. 4*c* is cross-sectional view of the bottle 10 of FIG. 4*b*, showing the ridges 17 projecting from the interior surface of a side wall 14. FIG. 4*d* is a more detailed view of region B of FIG. 4*c*. FIG. 4*d* shows the cover locking receptacle 16, which engages a locking lug of cover 20 to secure the cover 20 to the bottle 10.

Figure 5:
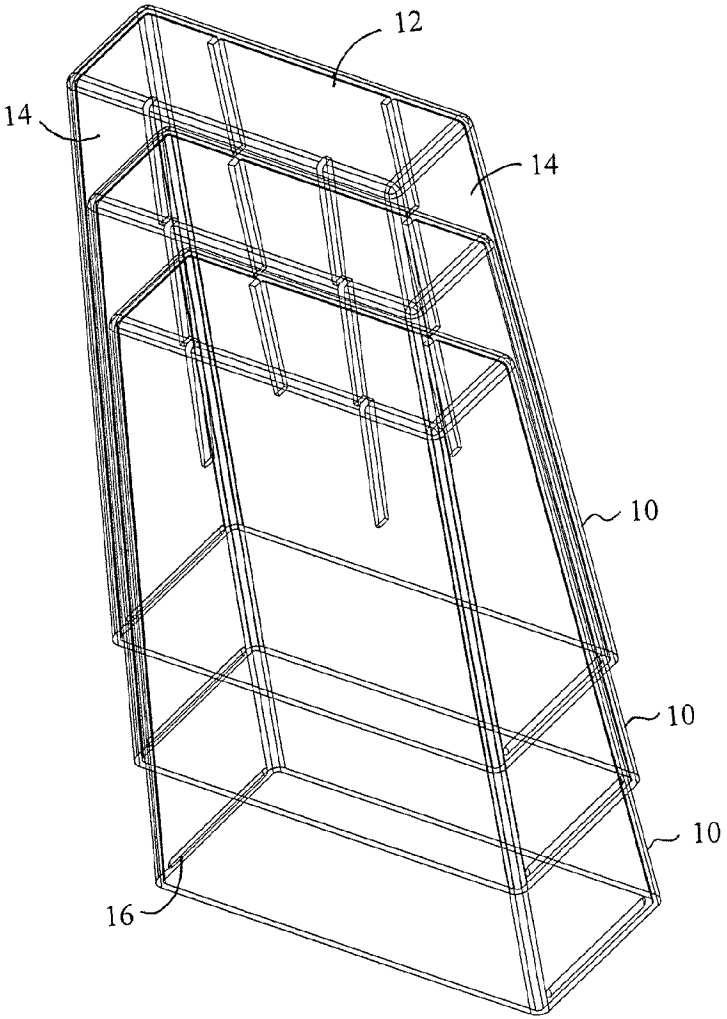
FIG. 5 is a perspective view of the bottles shown in FIG. 4*a* in a nested stack.

FIG. 5 is a perspective illustration of a plurality of bottles 10 shown in a nested stack. As shown, the bottom walls 12 and portions of side walls 14 are sized to be received within an opening of an adjacent bottle 10. In this manner, a compacted plurality of bottles 10 can be provided to an automated filling system.

Figure 6:
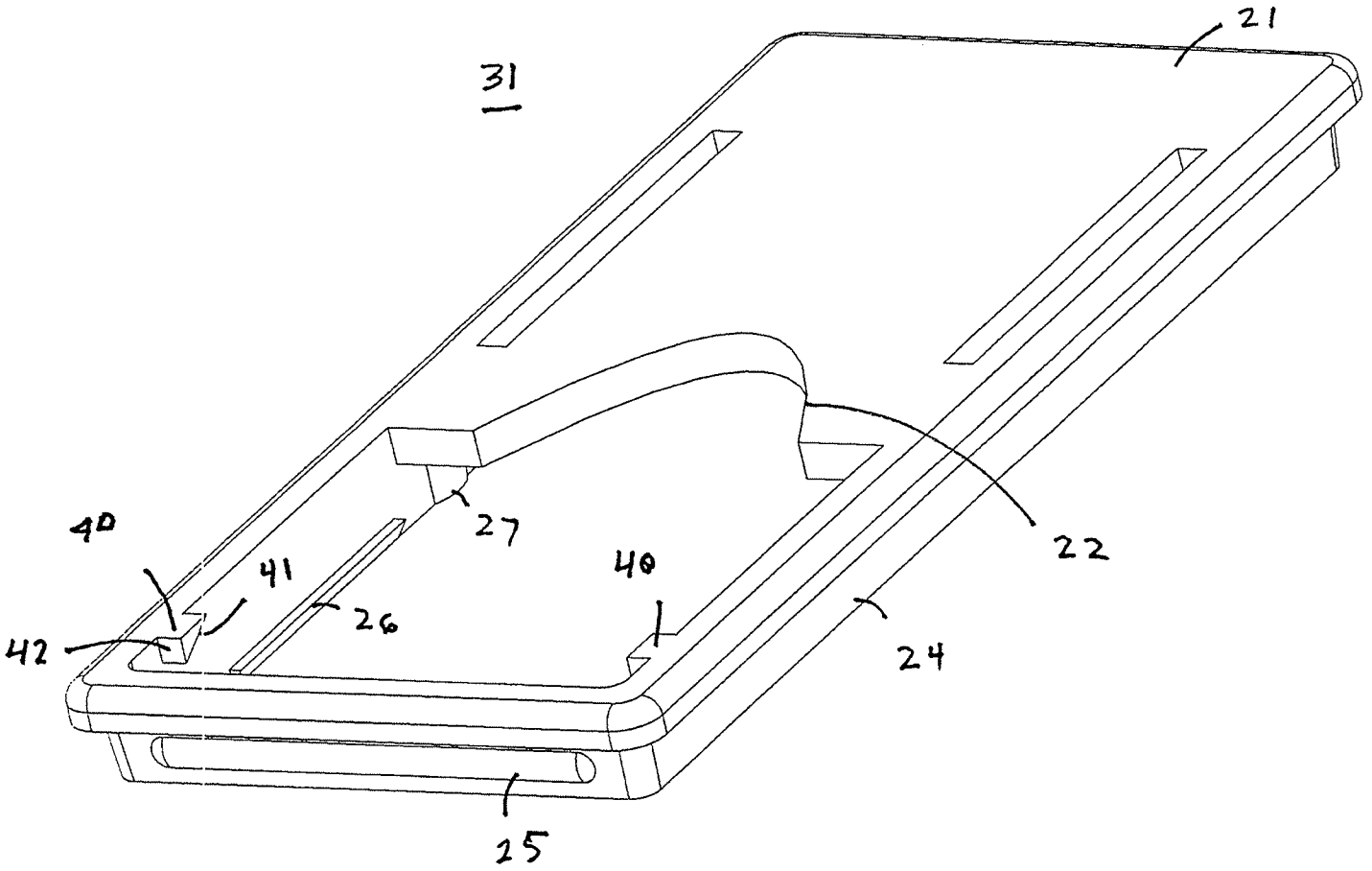
FIG. 6 is a top perspective view of a cover housing in accordance with the present invention.

FIG. 6 is a top perspective illustration of cover housing 31 showing a top wall 21, a recess 22 in the top wall, an opening 23, cover side walls 24, and a locking lug 25. The locking lug 25 is adapted to engage cover locking receptacle 16 of bottle 10, which is shown in FIGS. 2, 3, 4*d*, and 5. Locking lug 25 engages cover locking receptacle 16 to secure cover 20 to bottle 10. Inclined tab 40 includes an inclined surface 41 and a generally vertical wall 42. As described herein, inclined tab 40 is a component of the child-resistant closure mechanism.

Figure 7:
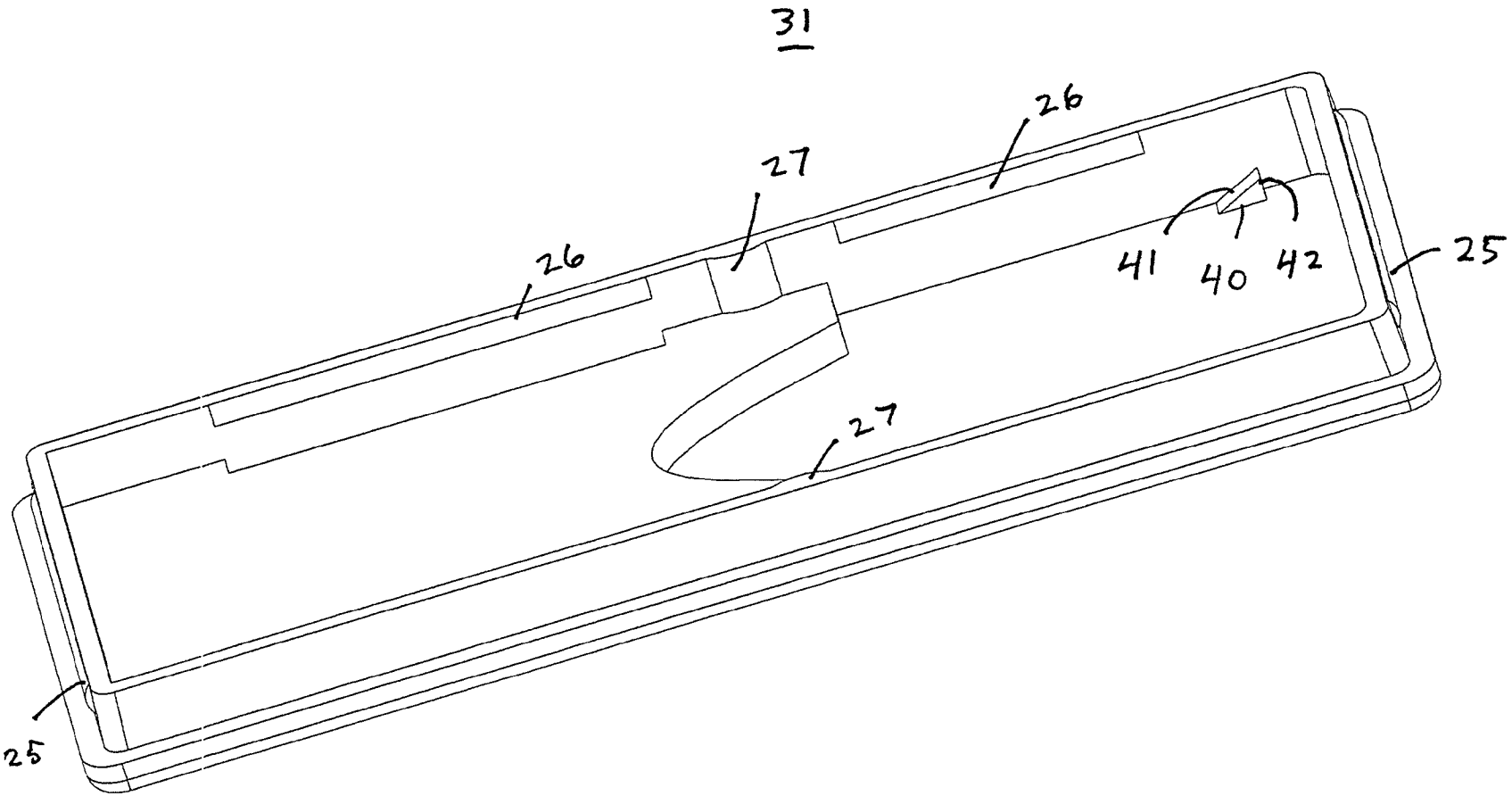
FIG. 7 is a bottom perspective view of the cover housing of FIG. 6.
Figure 8:
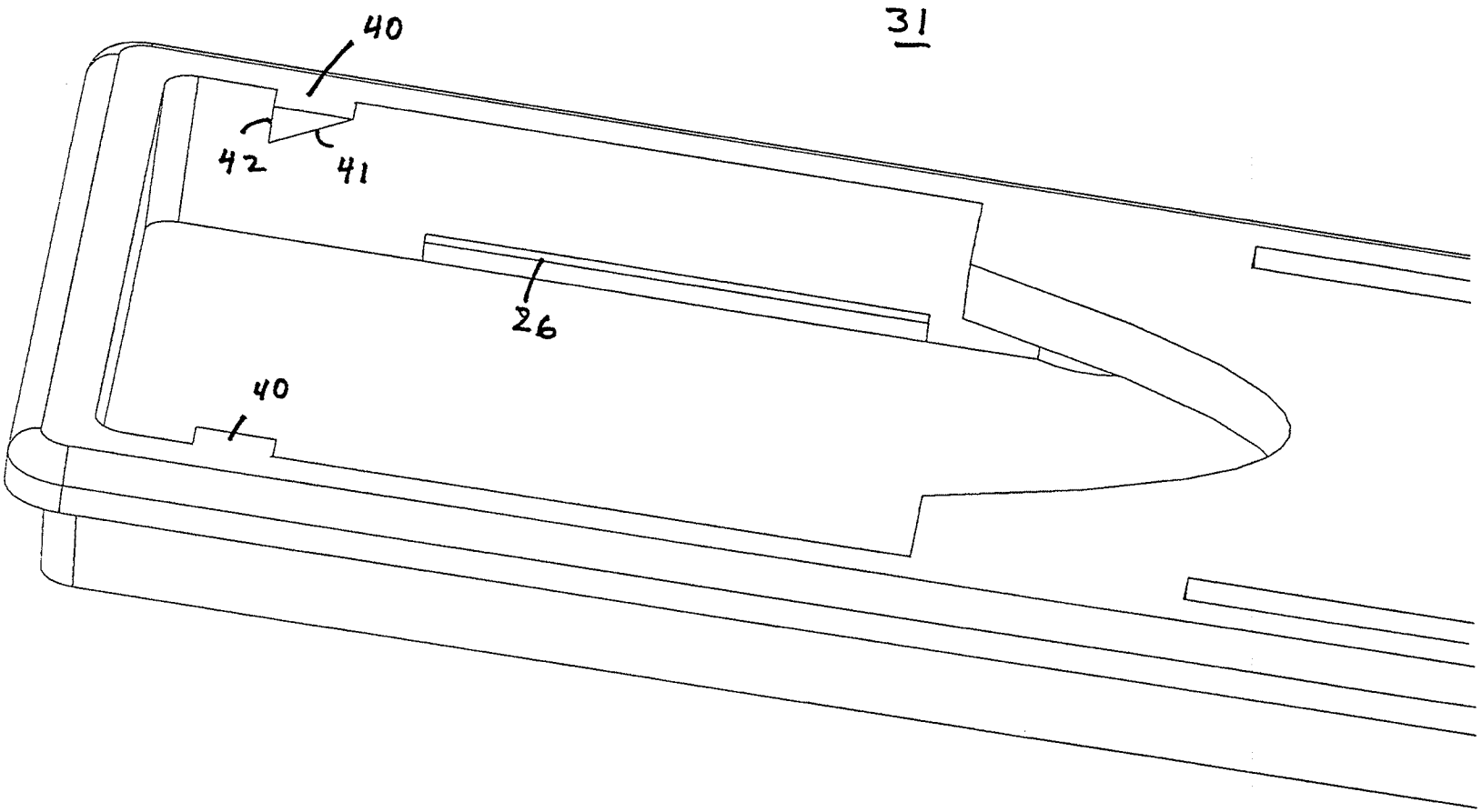
FIG. 8 is a top perspective view of a portion of the cover housing of FIG. 6.
Figure 9:
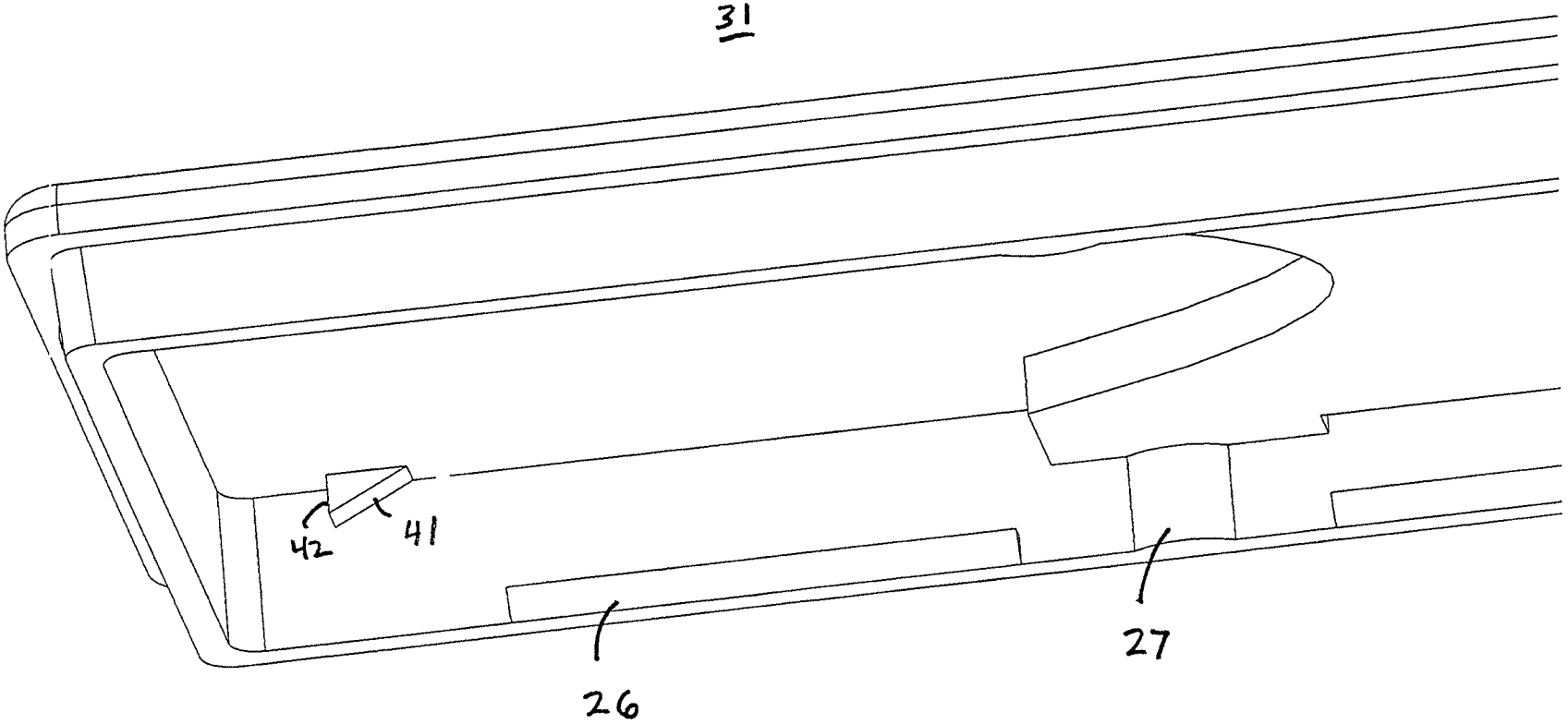
FIG. 9 is a bottom perspective view of a portion of the cover housing of FIG. 6.
Figure 10:
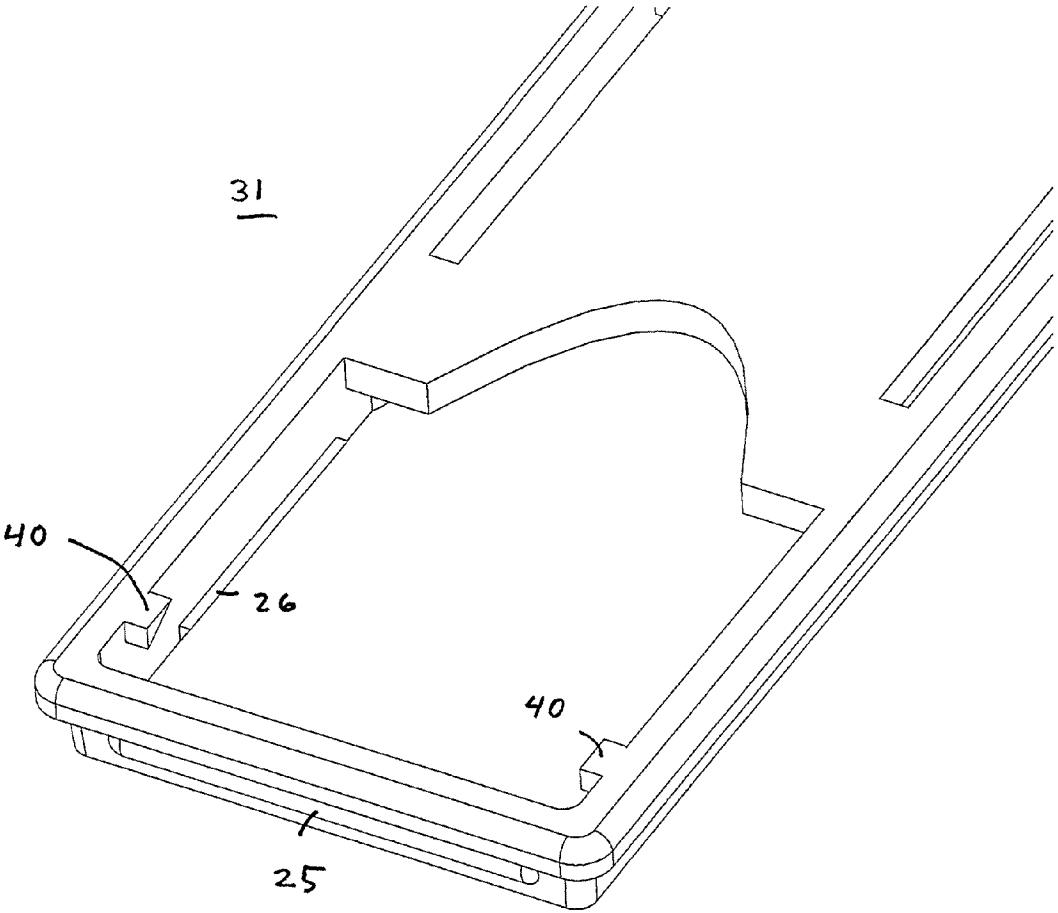
FIG. 10 is a top perspective view of a portion of the cover housing of FIG. 6.
Figure 11:
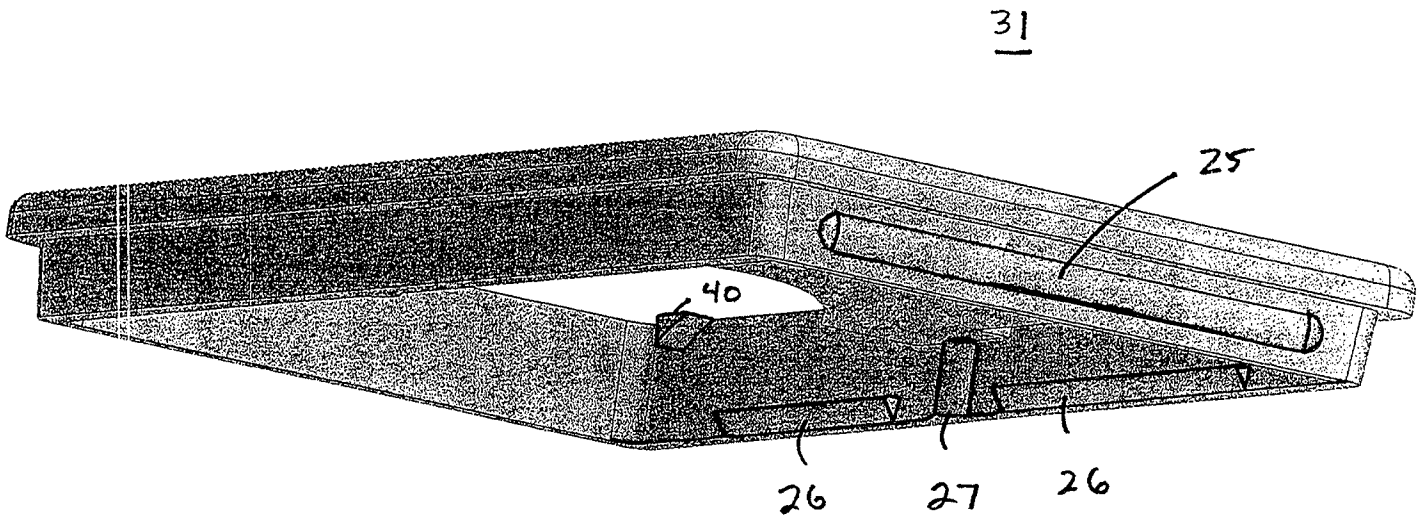
FIG. 11 is a bottom perspective view of a portion of the cover housing of FIG. 6.
Figure 12:
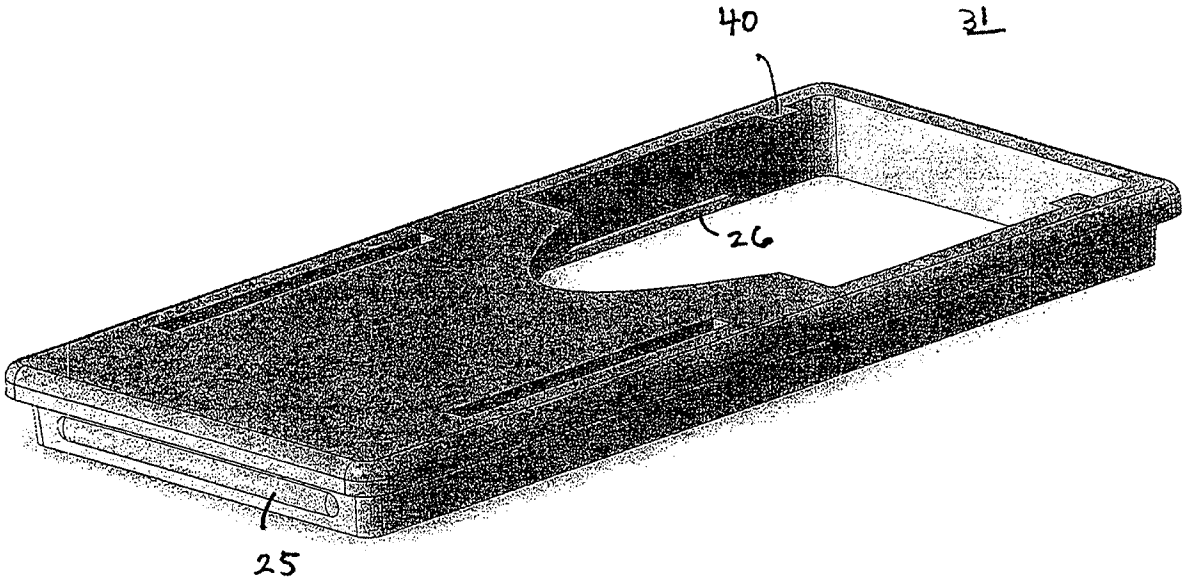
FIG. 12 is a top perspective view of a portion of the cover housing of FIG. 6.

FIG. 7 is a bottom perspective illustration of cover housing 31, showing lid retainers 26 projecting from interior surfaces of cover side walls 24. Lid retainers 26 are adapted to capture the sliding lid 30. The inner dimensions of cover 20 and retainers 26 are adapted to allow sliding lid 30 to slide relative to cover 20. Also shown are lid locking lugs 27, which project from interior surfaces of cover side walls 24. The lid locking lugs 27 are adapted to engage grooves 38, or detent structures, of sliding lid 30. While FIG. 7 shows four lid retainers 26 and two lid locking lugs 27, various numbers and configurations of lid retainers and lid locking lugs may be used in accordance with the present invention.

FIGS. 8 through 12 are perspective illustrations of the cover housing 31.

Figure 13:
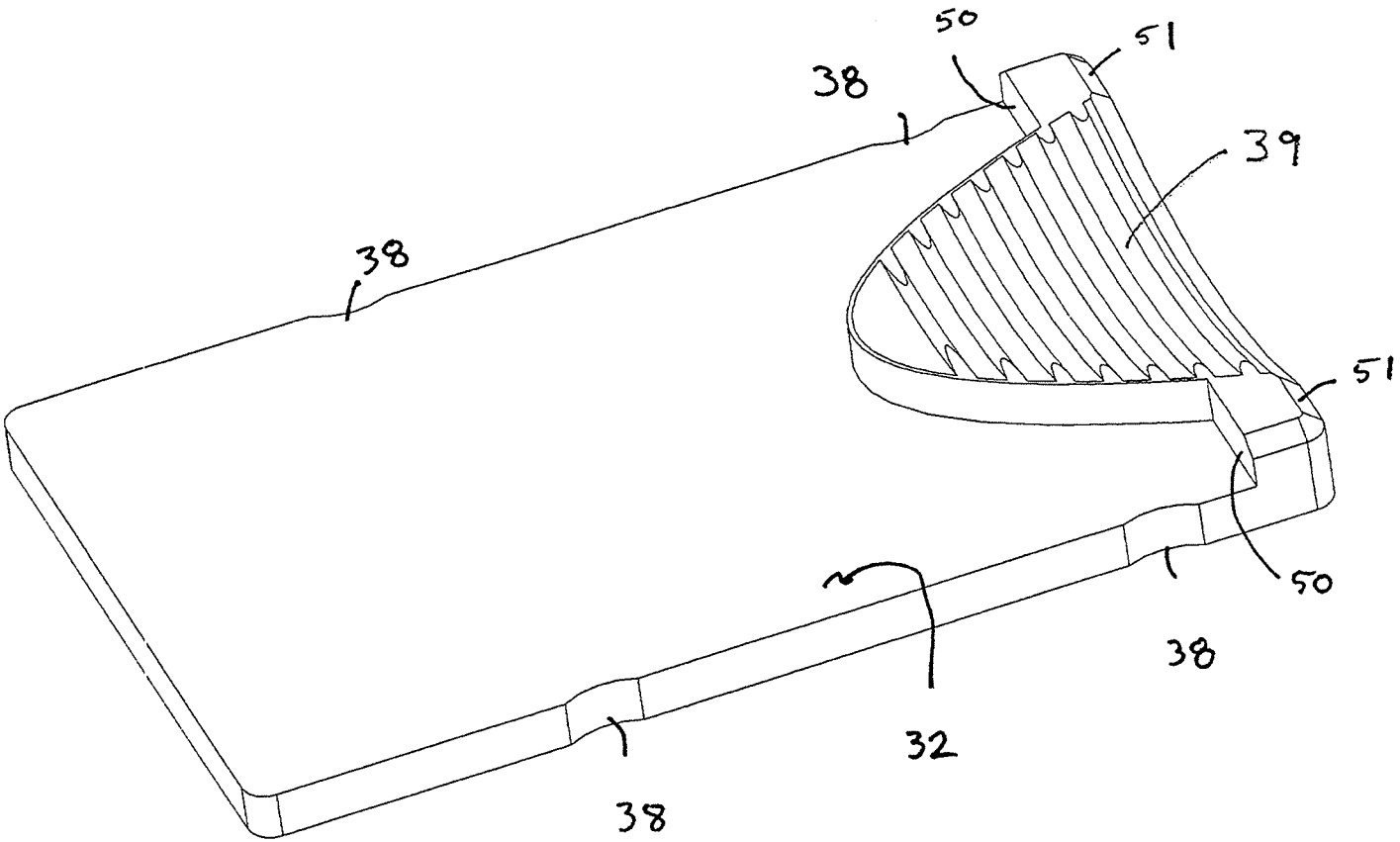
FIG. 13 is a top perspective view of a sliding lid in accordance with the present invention.
Figure 14:
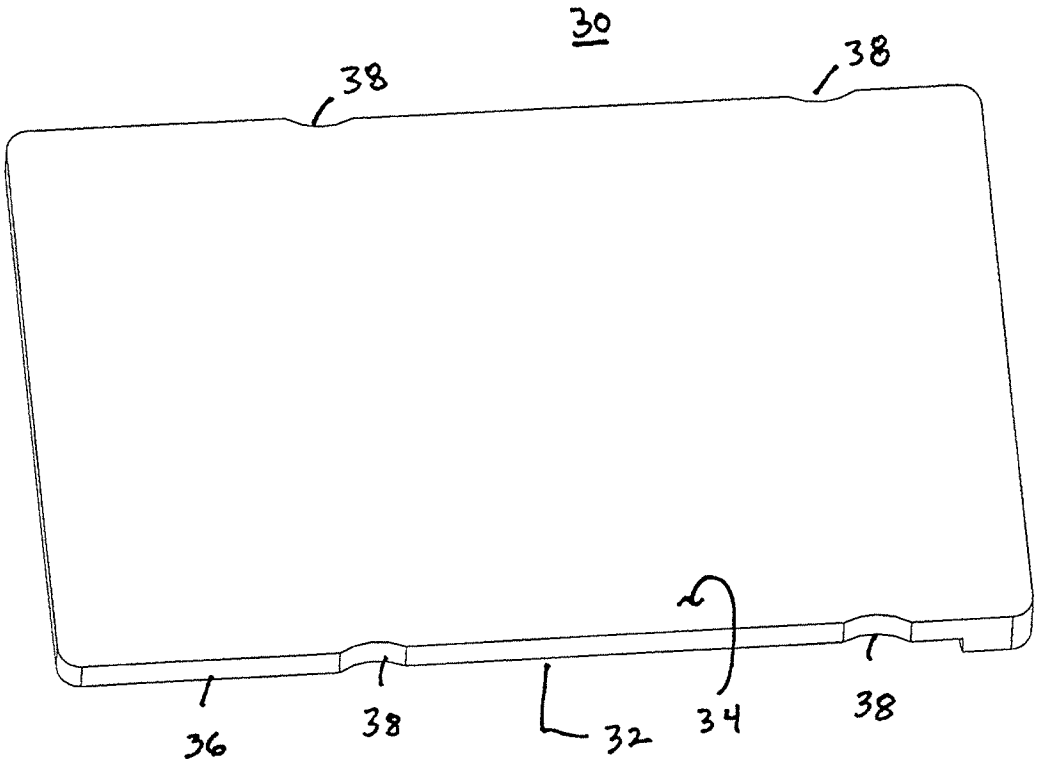
FIG. 14 is a bottom perspective view of a sliding lid in accordance with the present invention.
Figure 15:
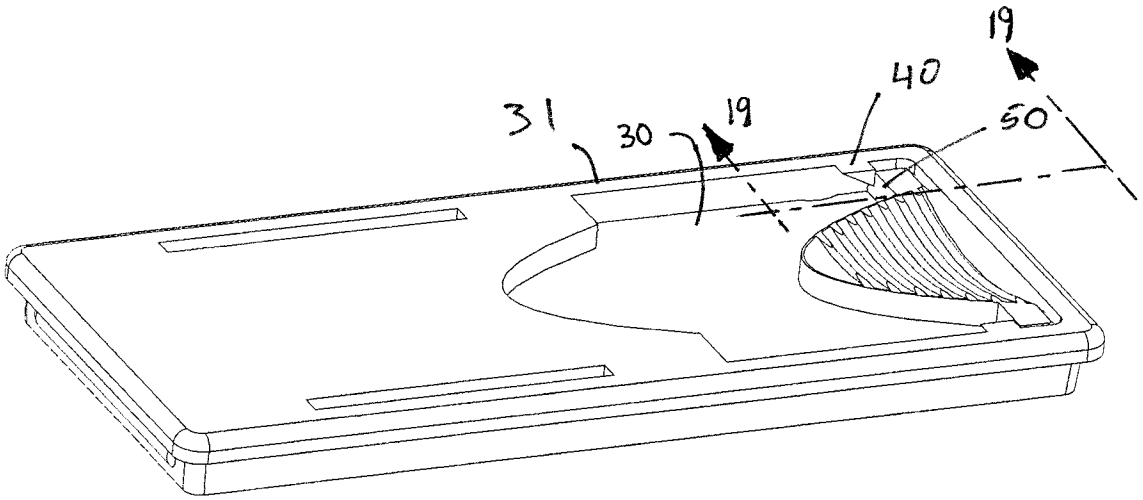
FIG. 15 is a top perspective view of a cover in accordance with the present invention, including a cover housing and a sliding lid.
Figure 16:
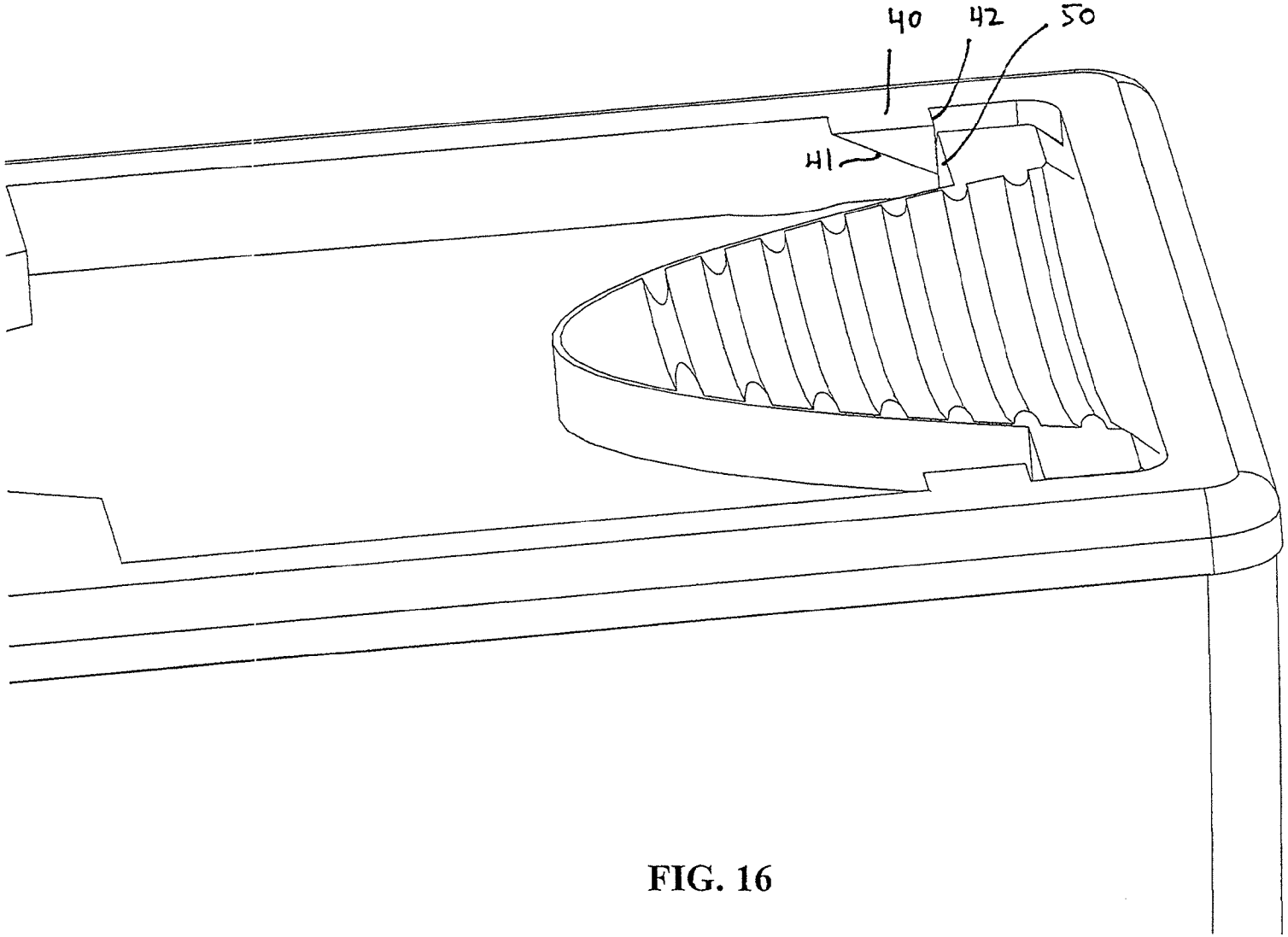
FIG. 16 is a top perspective view of a portion of the pharmaceutical container of FIG. 1.
Figure 17:
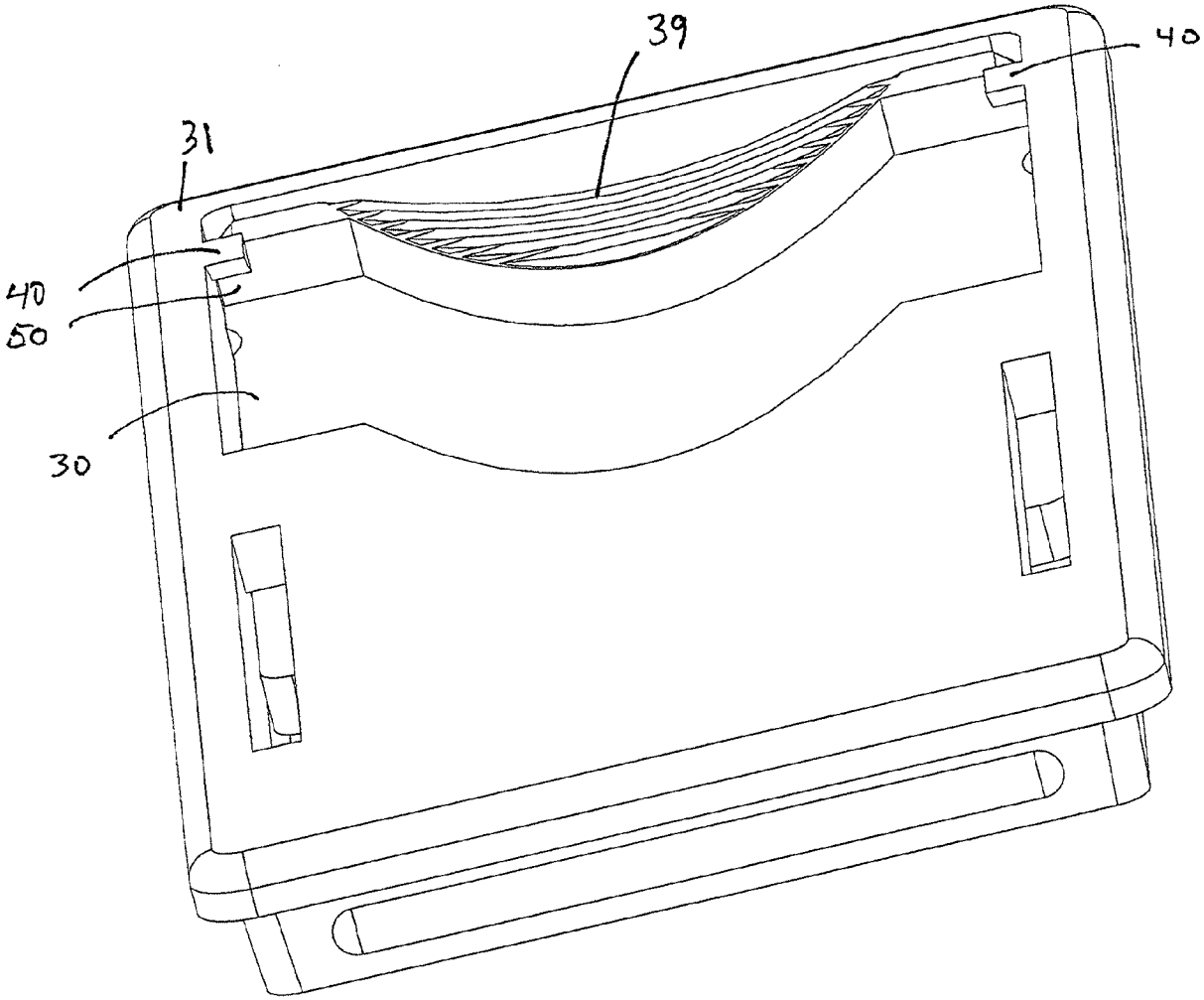
FIG. 17 is a top perspective view of the cover of FIG. 15.
Figure 18:
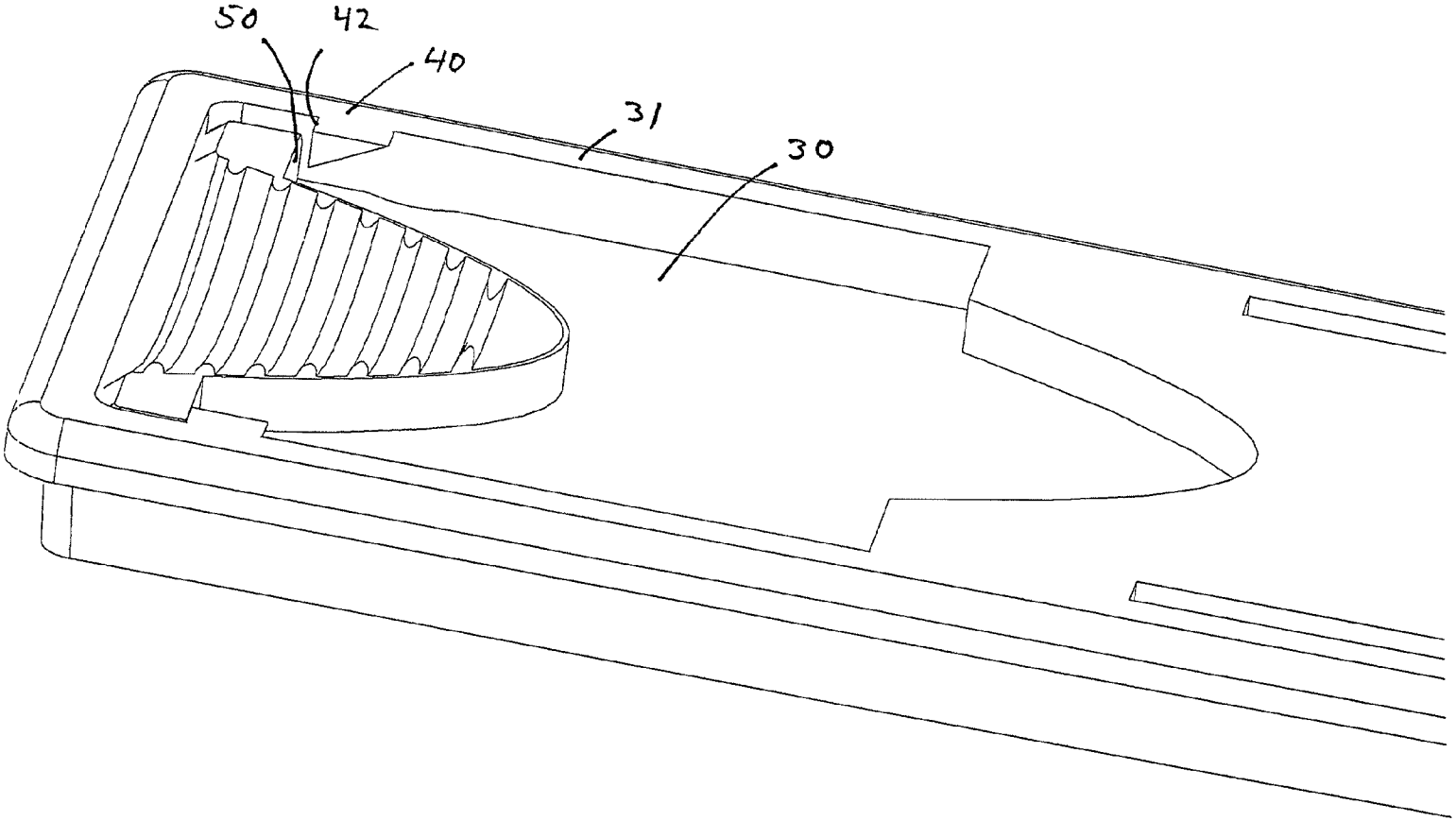
FIG. 18 is a top perspective view of a portion of the cover of FIG. 15.

FIGS. 13 and 14 are perspective illustrations of the sliding lid 30. Sliding lid 30 includes a top wall 32, a bottom wall 34, and side edges 36. A plurality of detent structures in the form of grooves 38 in the side edges 36 are also shown. The detent structures 38 are adapted to engage lid locking lugs 27 of the cover housing 31. Sliding lid 30 includes an inclined surface 51 and a generally vertical wall 50.

FIGS. 15 through 18 are perspective illustrations of the cover 20, including cover housing 31 and sliding lid 30. In a closed and locked condition, the vertical wall 50 of the sliding lid 30 engages wall 42 of the cover housing 31 to prevent opening of the sliding lid 30.

FIG. 19 is a cross-sectional view of the cover 20. To open sliding lid 30, a force, F, is applied to deflect a cantilevered portion, CP, of sliding lid 30. With sufficient force, F, the cantilevered portion, CP, pivots about a pivot point, PV, releasing the engagement between the vertical walls 50 and 42. Thus, to open the container, a "downward and backward" force is applied to finger lug 39. Then, to close the container, a "forward" force is applied to finger lug 39 causing the sliding cover 31 to move toward a closed position. As the cover is closed, the inclined surface 51 of sliding lid 30 engages the inclined surface 41 of tab 40 and the cantilevered portion, CP, of the sliding lid 30 deflects downward until the sliding lid 30 is fully closed.

Figure 20:
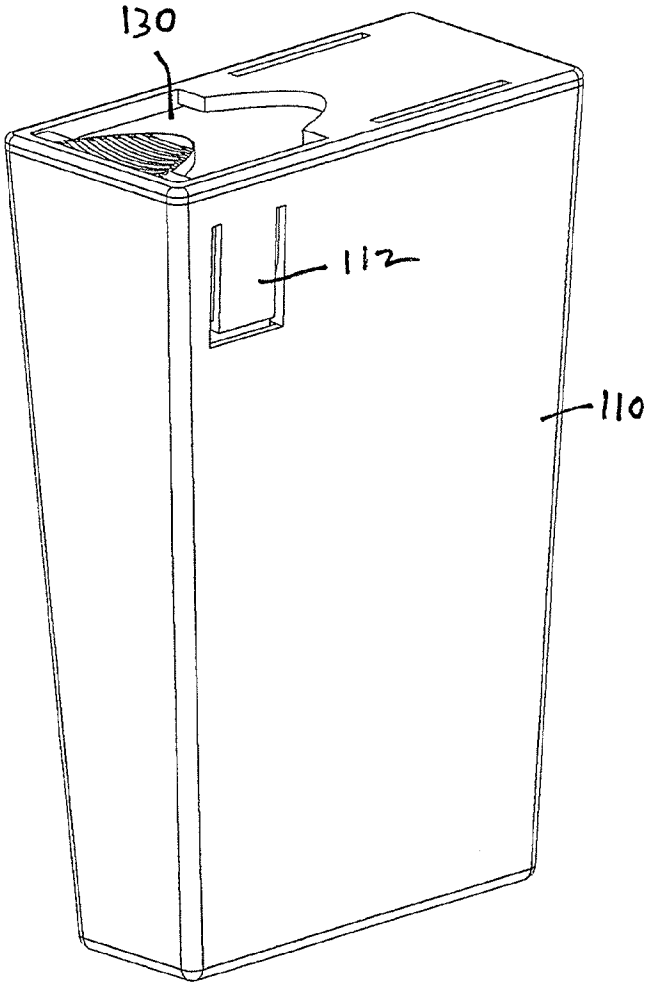
FIG. 20 is a perspective view of a second embodiment of a pharmaceutical container in accordance with the present invention, including a bottle and cover.

A second embodiment of the present invention is illustrated in FIG. 20. Tapered rectangular bottle 110 includes a tab element 112 which is a component in a child-resistant closure. Tab element 112 is defined by a generally U-shaped opening in the bottle 110 wall. An external force is applied to the tab element 112 to release the sliding lid 130.

Figure 21:
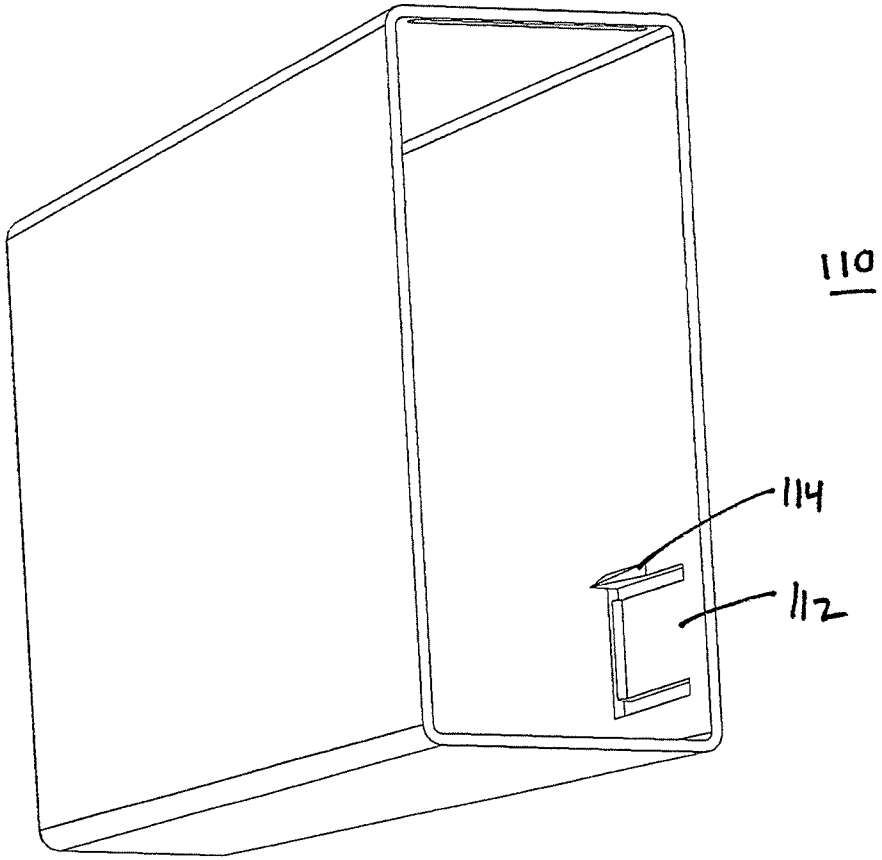
FIG. 21 is a top perspective view of the inside of the bottle of FIG. 20.
Figure 22:
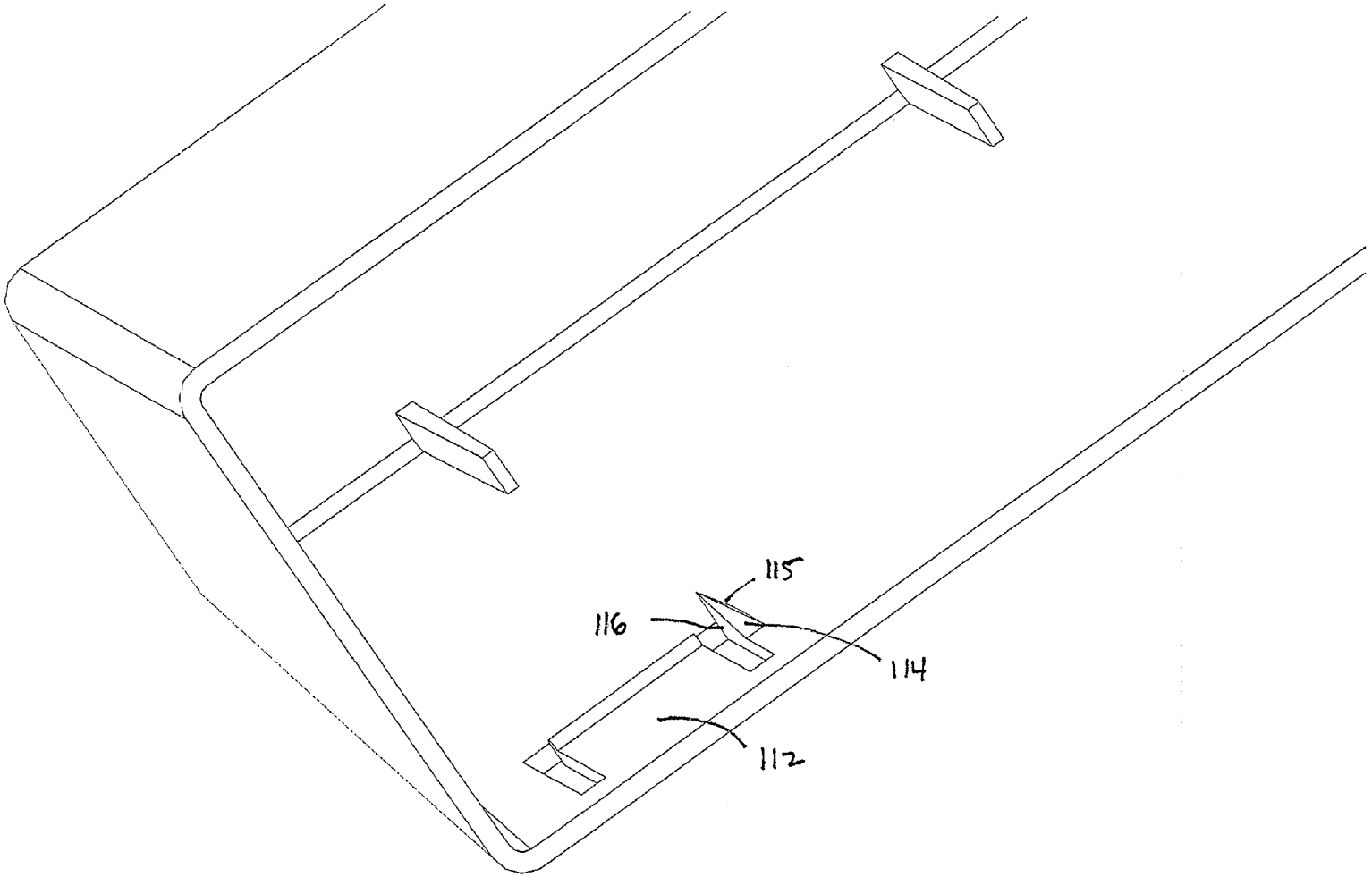
FIG. 22 is a top perspective view of a portion of the inside of the bottle of FIG. 20.

FIGS. 21 and 22 illustrate the inside of bottle 110. A latch 114 is positioned adjacent to tab element 112. Latch 114 includes an inclined surface 115 and a generally planar surface 116.

Figure 23:
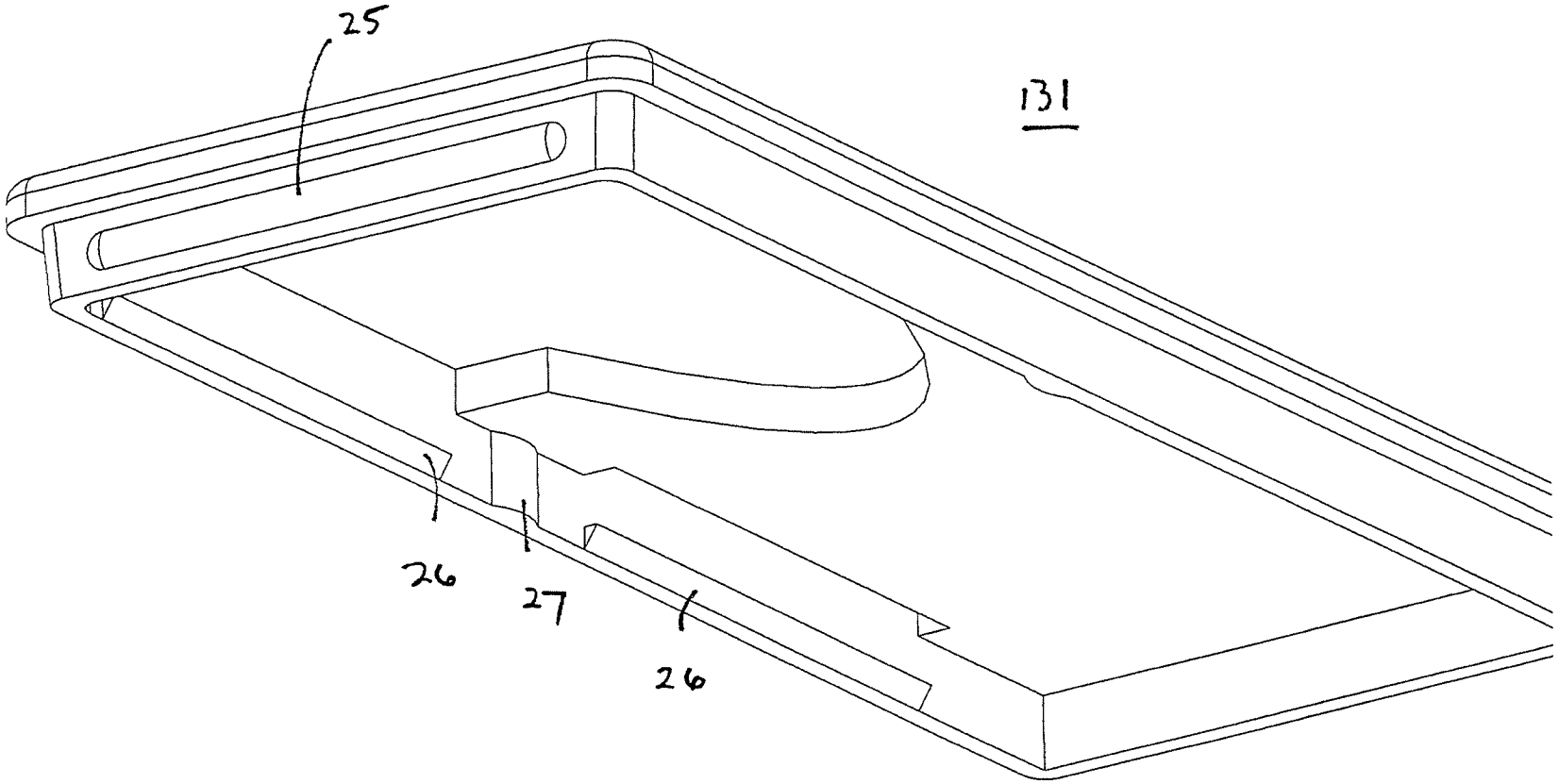
FIG. 23 is a bottom perspective view of a portion of the cover housing of FIG. 20.
Figure 24:
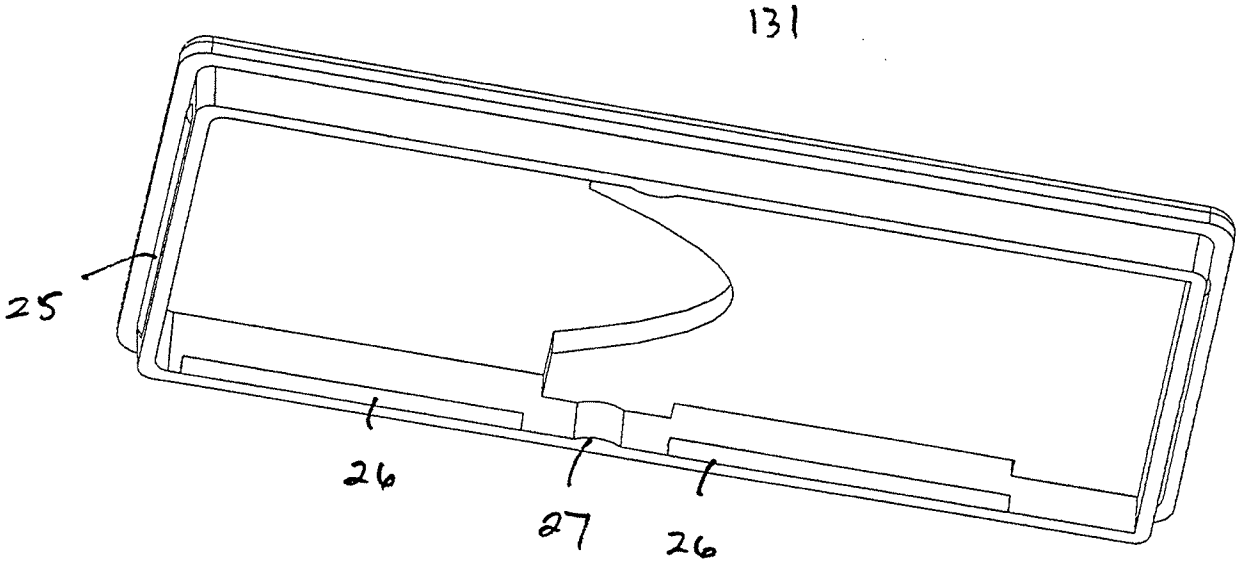
FIG. 24 is a bottom perspective view of a portion of the cover housing of FIG. 20.
Figure 25:
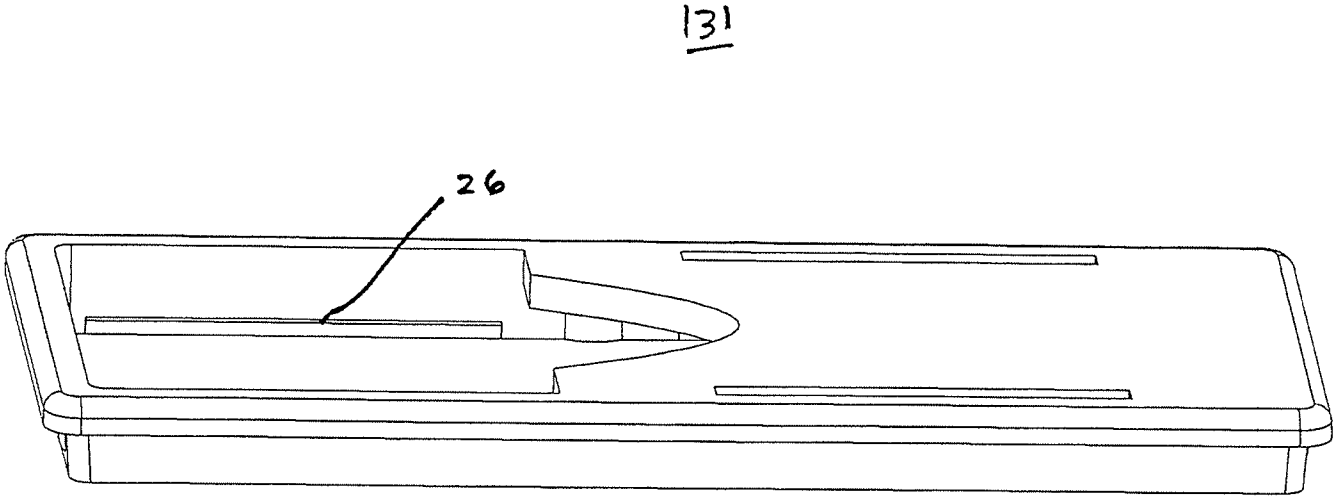
FIG. 25 is a top perspective view of a portion of the cover housing of FIG. 20.

FIGS. 23 through 25 illustrate the cover housing 131.

Figure 26:
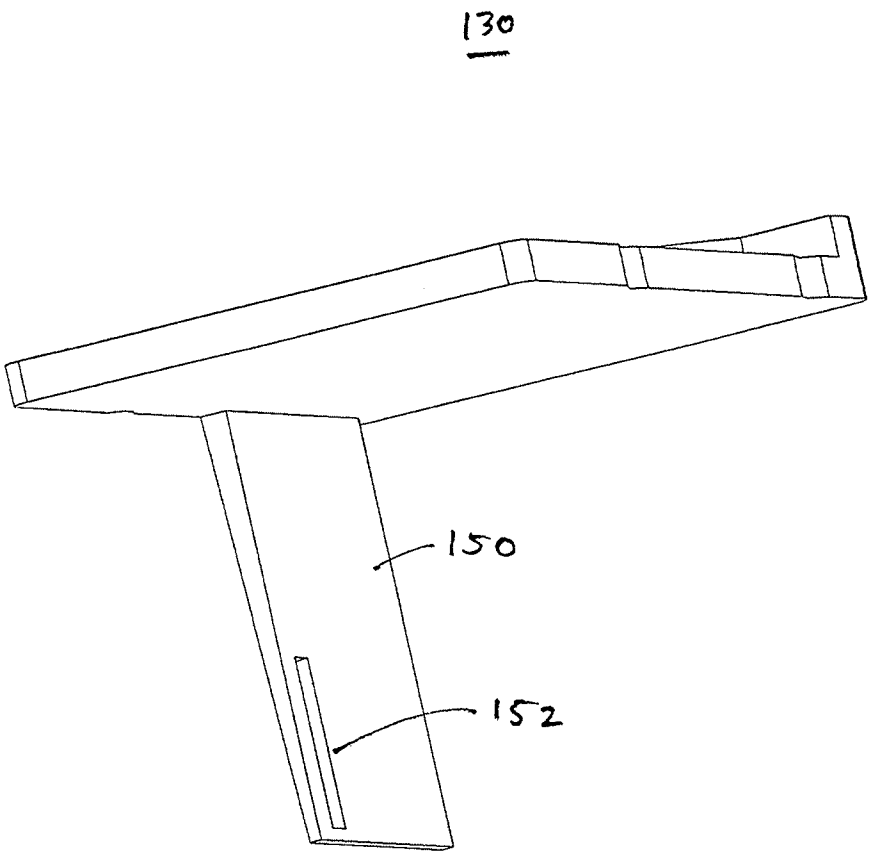
FIG. 26 is a bottom perspective view of the sliding lid of FIG. 20.
Figure 27:
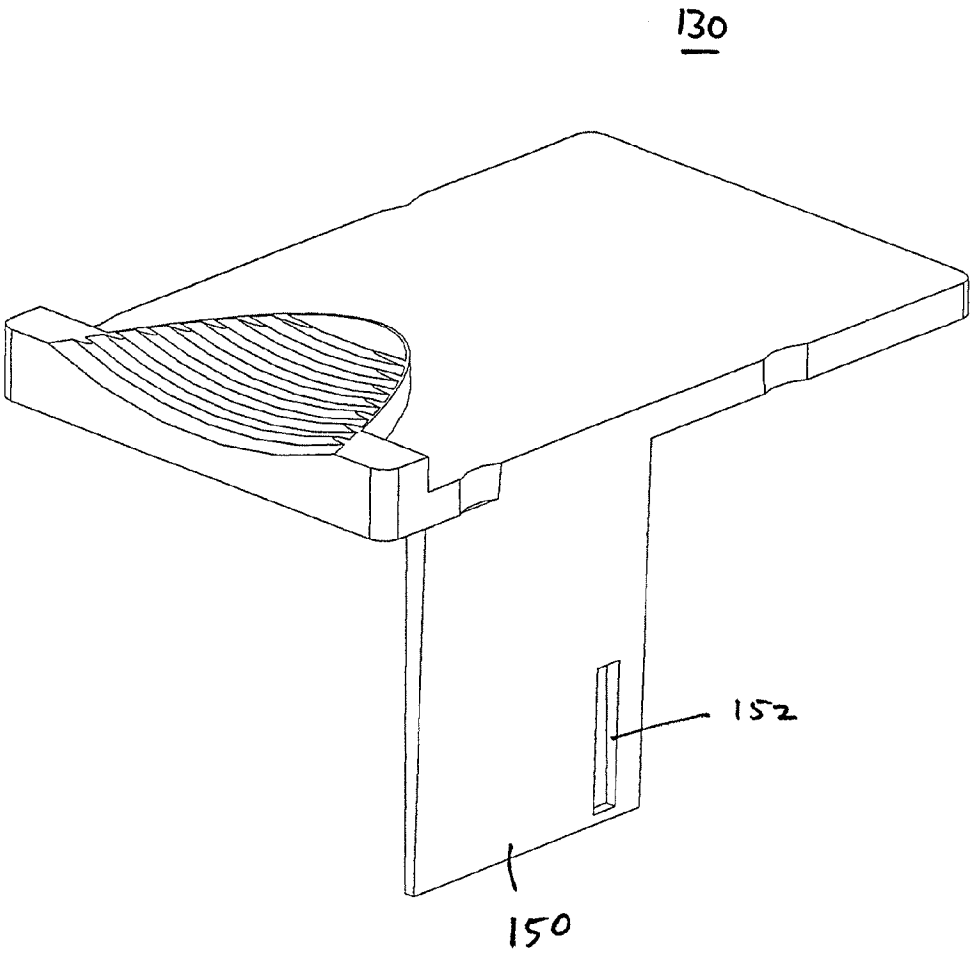
FIG. 27 is a top perspective view of the sliding lid of FIG. 20.

FIGS. 26 and 27 illustrate the sliding lid 130. Lid 130 includes a downwardly directed tab 150 having an elongated opening 152. In a locked position, such as shown in FIG. 28, the opening 152 captures the latch 114 of bottle 110 and prevents the sliding lid 130 from opening. In a locked position, the planar surface 116 of the latch 114 engages the edges of opening 152 and prevents the sliding lid 130 from opening.

Figure 29:
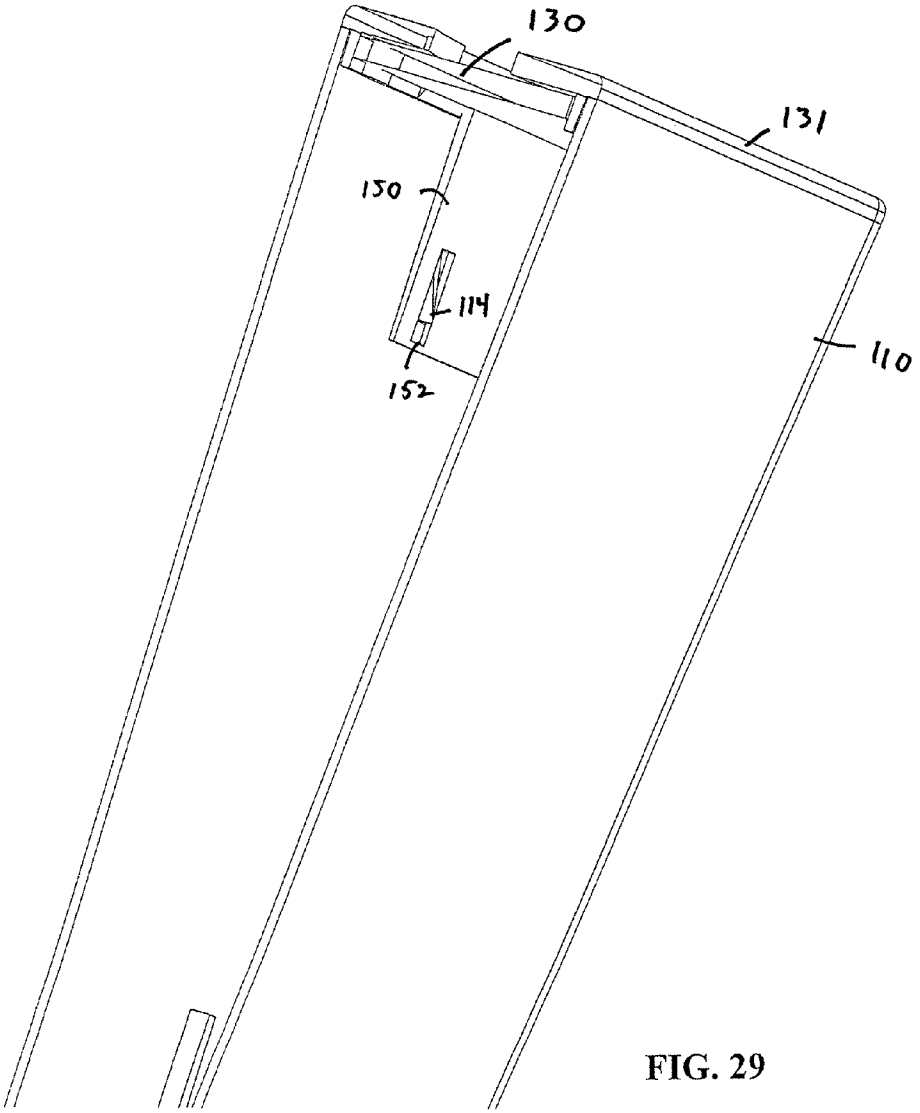
FIG. 29 is a cross-sectional view of a portion of the pharmaceutical container of FIG. 20.

FIG. 29 is a cross-sectional view of the bottle 110, lid 130 and cover housing 131 showing the latch 114 received into opening 152.

Figure 30:
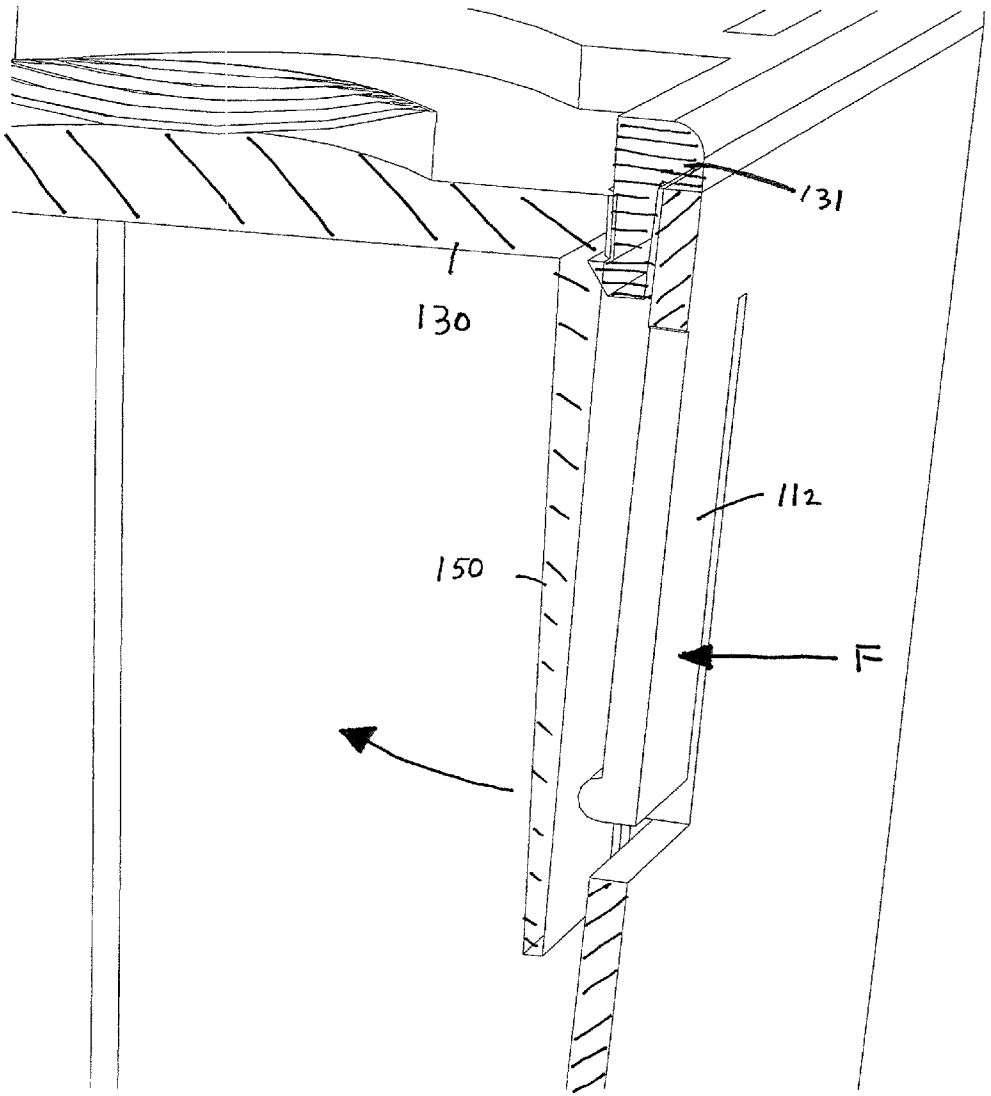
FIG. 30 is another cross-sectional view of a portion of the pharmaceutical container of FIG. 20.

FIG. 30 is another cross-sectional view of the bottle 110, lid 130 and cover housing 131 depicting an external force, F, applied to the tab element 112. The force, F, causes the tab element 112 to deflect into engagement with the tab 150. Upon sufficient external force, the tab 150 deflects to release the latch 114 from opening 152, thus releasing the sliding lid 130. To open the bottle 110, the user applies an external force, F, to release the latch 114 from opening 152 and also applies a "forward" force to open the sliding lid 130. To close the bottle 110, the user applies a "backward" force to slide the lid 130 toward a closed position. As the lid 130 is returned to the locked position, the inclined surface 115 of latch 114 engages the tab 150 of lid 130 and tends to bias the tab 150 inwardly to as to allow the latch 114 to reenter the opening 152. It may be desirable to add a "Push Here" or "To Release Cap" mold inscription or arrow symbol to assist the patient or caregiver in easily releasing the sliding lid 130.

Although the present invention and its advantages have been described in detail, it should be understood that various changes, substitutions and alterations can be made herein without departing from the spirit and scope of the invention. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A pharmaceutical container comprising:

a tapered rectangular bottle comprising a bottom wall and side walls including a first side wall and a second side wall, each of the side walls having a top end and a bottom end; and a cover having a sliding lid contained in a cover housing, said cover housing having a top wall and four cover side walls including a first cover side wall and a second cover side wall, said top wall including an elongated opening having a first end near a side of the cover and a second end near a central portion of the cover, and said cover including a tab positioned at the first end of the opening, with said tab having an inclined surface and a wall, and said sliding lid having a wall, wherein a first lid retainer and a second lid retainer project from interior surfaces of two cover side walls of the four cover side walls, and wherein the first and second lid retainers extend along the opening of the cover, and with no portion of the first and second lid retainers being positioned directly under the tab of the cover, said first and second lid retainers engaging the sliding lid such that the sliding lid is slidably mounted in the cover housing, wherein the sliding lid is adapted to slide between an open position and a closed position, wherein the sliding lid includes four side edges including a first side edge and a second side edge, wherein a cantilevered portion of the sliding lid is deflected into the cover opening upon contact between the sliding lid and the inclined surface of the cover tab, the cantilevered portion being that portion of the sliding lid which is underneath the cover tab and unsupported by the first and second lid retainers, and with the wall of the cover tab engaging the wall of the sliding lid to lock the sliding lid into place, and wherein the engagement between the wall of the sliding lid and the wall of the cover tab is released when sufficient force is applied to the cantilevered portion of the sliding lid, said force causing the cantilevered portion of the sliding lid to deflect into the cover opening to allow the sliding lid to slide open and away from the cover tab.

2. The pharmaceutical container of claim 1, wherein the sliding lid includes a first groove adapted to engage a first lid locking lug and a third groove adapted to engage the first lid locking lug, and said second side edge including a second groove adapted to engage a second lid locking lug and a fourth groove adapted to engage the second lid locking lug.

3. The pharmaceutical container of claim 1, wherein a third lid retainer and a fourth lid retainer project from interior surfaces of the two cover side walls of the four cover side walls, said third and fourth lid retainers engaging the sliding lid such that the sliding lid is slidably mounted in the cover housing.

4. The pharmaceutical container of claim 1, wherein the sliding lid covers the opening of the top wall of the cover housing when the sliding lid is in the closed position.

5. The pharmaceutical container of claim 1, wherein a plurality of ridges proximate to the bottom wall project from the interior surface of at least one of the side walls of the bottle.

6. The pharmaceutical container of claim 1, wherein a label having two end portions and an intermediate bridge portion is affixed to the bottle, such that each of the two end portions is affixed to one of the side walls of the bottle, and the intermediate bridge portion is affixed to the top wall of the cover housing away from the opening of the cover housing, with the lid being slidable between open and closed positions without removal of the label.

7. The pharmaceutical container of claim 1, wherein a first bottle locking lug projects from an exterior surface of the first cover side wall, said first bottle locking lug adapted to engage a first cover locking receptacle of the bottle, and wherein a second bottle locking lug projects from an exterior surface of a second cover side wall, said second bottle locking lug adapted to engage a second cover locking receptacle.

8. The pharmaceutical container of claim 1, said side walls of the bottle include a third side wall and a fourth side wall, wherein said bottle includes a third cover locking receptacle proximate to the top end of the third side wall, and a fourth cover locking receptacle proximate to the top end of the fourth side wall, and said four cover side walls including a third cover side wall and a fourth cover side wall, wherein a third bottle locking lug projects from an exterior surface of the third cover side wall, said third bottle locking lug adapted to engage the third cover locking receptacle of the bottle, and wherein a fourth bottle locking lug projects from an exterior surface of the fourth cover side wall, said fourth bottle locking lug adapted to engage the fourth cover locking receptacle of the bottle.

9. The pharmaceutical container of claim 1, wherein the sliding lid comprises a recess adapted to engage the thumb of a user.

10. An array of pharmaceutical containers comprising:

a plurality of tapered rectangular bottles, each bottle comprising a bottom wall and side walls including a first side wall and a second side wall, each of the side walls having a top end and a bottom end, wherein the bottom end is connected to the bottom wall, said bottle including a first cover locking receptacle proximate to the top end of the first side wall, and a second cover locking receptacle proximate to the top end of the second side wall, wherein a ridge proximate to the bottom wall projects from an interior surface of at least one of the side walls; and a plurality of covers, each cover having a sliding lid contained in a cover housing, said cover housing having a top wall and four cover side walls including a first cover side wall and a second cover side wall, said top wall including an elongated opening, and said covers each including a tab having an inclined surface and a wall, with each tab being positioned at one end of the opening, and said each sliding lid having a wall;

wherein a first lid retainer and a second lid retainer, and a first lid locking lug and a second lid locking lug, project from interior surfaces of two cover side walls of the four cover side walls, said first and second lid retainers engaging the sliding lid such that the sliding lid is slidably mounted in the cover housing, and wherein the first and second lid retainers extend along the opening of the cover, and with no portion of the first and second lid retainers being positioned directly under the tab of the cover, wherein the sliding lid is adapted to slide between an open position and a closed position, and wherein the sliding lid includes four side edges including a first side edge and a second side edge, said first side edge including a first groove adapted to engage the first lid locking lug, and said second side edge including a second groove adapted to engage the second lid locking lug;

wherein the plurality of bottles are nested, such that the bottom wall of a first bottle of the plurality of bottles contacts a top edge of the ridge proximate to the bottom wall of a second bottle of the plurality of bottles, wherein a cantilevered portion of the sliding lid is deflected into the cover opening upon contact between the sliding lid and an inclined surface of the cover tab, the cantilevered portion being that portion of the sliding lid which is underneath the cover tab and unsupported by the first and second lid retainers, and with the wall of the cover tab engaging the wall of the sliding lid to lock the sliding lid into place, and wherein the engagement between the wall of the sliding lid and the wall of the cover tab is released when sufficient force is applied to the cantilevered portion of the sliding lid, said force causing the cantilevered portion of the sliding lid deflect into the cover opening to allow the cover to slide open and away from the cover tab.

11. The array of claim 10, wherein the sliding lid of each cover of the plurality of covers includes a third groove adapted to engage the first lid locking lug, and a fourth groove adapted to engage the second lid locking lug.

12. The array of claim 10, wherein a third lid retainer and a fourth lid retainer project from interior surfaces of the two cover side walls of the four cover side walls, said third and fourth lid retainers engaging the sliding lid such that the sliding lid is slidably mounted in the cover housing of each cover of the plurality of covers.

13. The array of claim 10, wherein, for each cover of the plurality of covers, the sliding lid covers the opening of the top wall of the cover housing when the sliding lid is in the closed position.

14. The array of claim 10, wherein a plurality of ridges proximate to the bottom wall project from the interior surface of at least one of the side walls of each bottle of the plurality of bottles.

15. The array of claim 10, further comprising a plurality of labels, each label having two end portions and an intermediate bridge portion, wherein each label is adapted to be affixed to a bottle of the plurality of bottles, such that each of the two end portions is affixed to one of the side walls of the bottle, and the intermediate bridge portion is affixed to the top wall of the cover housing away from the cover opening, with the sliding lid being operable between open and closed orientations without removal of the bridge portion of the label.

16. The array of claim 15, said side walls of each bottle of the plurality of bottles including a third side wall and a fourth side wall, wherein the bottle includes a third cover locking receptacle proximate to the top end of the third side wall, and a fourth cover locking receptacle proximate to the top end of the fourth side wall.

17. The array of claim 16, wherein a third bottle locking lug projects from an exterior surface of a third cover side wall, said third bottle locking lug adapted to engage the third cover locking receptacle of the bottle, and wherein a fourth bottle locking lug projects from an exterior surface of a fourth cover side wall, said fourth bottle locking lug adapted to engage the fourth cover locking receptacle of the bottle.

18. The array of claim 10, wherein the sliding lid of each cover of the plurality of covers comprises a recess adapted to engage the thumb of a user.

19. A pharmaceutical container comprising:

a tapered rectangular bottle comprising a bottom wall and side walls including a first side wall and a second side wall, each of the side walls having a top end and a bottom end; and a cover having a sliding lid contained in a cover housing, said cover housing having a top wall and four cover side walls including a first cover side wall and a second cover side wall, said top wall including an opening, and said cover including a tab positioned at one end of the cover opening near the first cover side wall and having an inclined surface and a wall, and with said sliding lid having a wall;

wherein a first lid retainer and a second lid retainer project from interior surfaces of two cover side walls of the four cover side walls, and wherein the first and second lid retainers extend along the opening of the cover, but with no portion of the first and second lid retainers being positioned directly under the tab of the cover, said first and second lid retainers engaging the sliding lid such that the sliding lid is slidably mounted in the cover housing, wherein the sliding lid is adapted to slide between an open position and a closed position, wherein the sliding lid includes four side edges including a first side edge and a second side edge, wherein a cantilevered portion of the sliding lid at the cover opening is deflected into the cover opening upon contact between the sliding lid and the inclined surface of the cover tab, the cantilevered portion being that portion of the sliding lid which is underneath the cover tab and unsupported by either the first and second lid retainers, and with the wall of the cover tab engaging the wall of the sliding lid to lock the sliding lid into place, and wherein the engagement between the wall of the sliding lid and the wall of the cover tab is released when sufficient force is applied to the cantilevered portion of the sliding lid at the cover opening, said force causing the cantilevered portion of the sliding lid to deflect into the cover opening to allow the sliding lid to slide open and away from the cover tab.

20. A pharmaceutical container comprising:

a bottle having four side faces and a bottom and an opened end;

a cover at the opened end of the bottle, said cover having an elongated opening with a first end of the opening being near a side of the cover and a second end near a central portion of the cover, and said cover including a tab positioned at the first end of the opening, with said tab having an inclined surface and a wall; and a sliding lid operable to close the opening of the cover, wherein the sliding lid is supported by a pair of lid retainers projecting from interior surfaces of the cover, wherein the pair of lid retainers extend along the opening of the cover, and with no portion of the pair of lid retainers being positioned directly under the tab of the cover, wherein a cantilevered portion of the sliding lid is deflected into the cover opening upon contact between the sliding lid and the inclined surface of the cover tab, the cantilevered portion being that portion of the sliding lid which is underneath the cover tab and unsupported by either pair of lid retainers, and with the wall of the cover tab engaging a wall of the sliding lid to lock the sliding lid into place, and wherein the engagement between the wall of the sliding lid and the wall of the cover tab is released when sufficient force is applied to the cantilevered portion of the sliding lid, said force causing the cantilevered portion of the sliding lid to deflect into the cover opening to allow the sliding lid to slide open and away from the cover tab.

21. The pharmaceutical container of claim 20, wherein a label having two end portions and an intermediate bridge portion is affixed to the bottle and cover, such that each of the two end portions is affixed to a bottle side wall, and the intermediate bridge portion is affixed to a top wall of the cover housing away from the opening of the cover housing, with the lid being slidable between open and closed positions without removal of the label.

22. The pharmaceutical container of claim 20 wherein the cover has a top wall away from the opening and a portion of the sliding lid extends underneath the top wall when the sliding lid is opened.

23. The pharmaceutical container of claim 22 wherein a label having two end portions and an intermediate bridge portion is affixed to the bottle and cover, with the intermediate bridge portion being affixed to the top wall of the cover housing.

* * * * *